US008870250B2

(12) United States Patent
Liebel et al.

(10) Patent No.: US 8,870,250 B2
(45) Date of Patent: Oct. 28, 2014

(54) SLIDING DOOR HANDLE AND LATCH

(71) Applicant: Milgard Manufacturing Incorporated, Taylor, MI (US)

(72) Inventors: Gordon H. Liebel, Buckley, WA (US); Michael A. Barton, Orting, WA (US); Eric A. Baczuk, Puyallup, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 0 days.

(21) Appl. No.: 13/926,197

(22) Filed: Jun. 25, 2013

(65) Prior Publication Data

US 2013/0285394 A1 Oct. 31, 2013

Related U.S. Application Data

(63) Continuation of application No. 12/823,029, filed on Jun. 24, 2010, now Pat. No. 8,491,022.

(60) Provisional application No. 61/220,506, filed on Jun. 25, 2009.

(51) Int. Cl.

| | |
|---|---|
| ***E05B 3/00*** | (2006.01) |
| ***E05B 1/00*** | (2006.01) |
| ***E05B 65/08*** | (2006.01) |
| ***E05B 7/00*** | (2006.01) |
| *E05B 63/18* | (2006.01) |

(52) U.S. Cl.

CPC ..... *E05B 1/00* (2013.01); *E05B 65/0858* (2013.01); *E05B 63/185* (2013.01); *E05B 7/00* (2013.01)

USPC ..... 292/336.3

(58) Field of Classification Search

CPC ..... E05B 85/16; E05B 17/0029

USPC ..... 292/336.3, 112, 160, 142, 199, 280, 292/DIG. 46, DIG. 30; 70/95; 49/503, 449, 49/501

See application file for complete search history.

(56) References Cited

U.S. PATENT DOCUMENTS

| | | | | | |
|---|---|---|---|---|---|
| 271,001 | A | * | 1/1883 | Thompson | 292/180 |
| 451,702 | A | * | 5/1891 | Sims | 292/241 |
| 466,419 | A | * | 1/1892 | Kelley | 292/123 |
| 700,343 | A | * | 5/1902 | Lincoln | 292/254 |
| 729,980 | A | * | 6/1903 | Vordemfelde | 292/29 |
| 1,064,800 | A | * | 6/1913 | Whitoomb | 292/173 |
| 1,414,513 | A | * | 5/1922 | Hueber | 74/397 |
| 2,631,032 | A | * | 3/1953 | Denker et al. | 49/278 |
| 2,659,115 | A | * | 11/1953 | Anderson et al. | 49/277 |

(Continued)

*Primary Examiner* — Kristina Fulton
*Assistant Examiner* — Nathan Cumar
(74) *Attorney, Agent, or Firm* — Rathe Lindenbaum LLP

(57) ABSTRACT

The present invention relates to a sliding door latch having a locked and unlocked position for a sliding door having an open and closed position. The sliding door latch includes a handle assembly with a handle and a locking mechanism. The handle is a first position, wherein the locking mechanism is engaged and the sliding door latch is locked, to a second position, wherein the locking mechanism is disengaged and the sliding door latch is unlocked. The locking mechanism may prevent the handle from moving from the second position to the first position when the sliding door is open. The handle is pivotable between the first position and the second position only when the door is closed. Resistance forces may prevent the handle from moving from the second position to the first position when the sliding door is closed without an application of force by a user.

18 Claims, 10 Drawing Sheets

(56) References Cited

U.S. PATENT DOCUMENTS

| | | | | | |
|---|---|---|---|---|---|
| 3,080,621 | A * | 3/1963 | Mendelsohn | 49/454 |
| 3,877,739 | A * | 4/1975 | Cowen | 292/101 |
| 3,912,311 | A * | 10/1975 | Carvell et al. | 292/216 |
| 4,767,139 | A * | 8/1988 | Hansing | 292/162 |
| 4,934,800 | A * | 6/1990 | Choi | 292/172 |
| 4,973,091 | A * | 11/1990 | Paulson et al. | 292/51 |
| 5,060,991 | A * | 10/1991 | Davidian et al. | 292/172 |
| 5,092,144 | A * | 3/1992 | Fleming et al. | 70/95 |
| 5,522,626 | A * | 6/1996 | Dominique | 292/198 |
| 5,810,402 | A * | 9/1998 | Armstrong | 292/39 |
| 5,908,228 | A * | 6/1999 | Lee | 312/405 |
| 5,915,805 | A * | 6/1999 | Lee | 312/405 |
| 5,951,068 | A * | 9/1999 | Strong et al. | 292/39 |
| 6,023,952 | A * | 2/2000 | Mantarakis et al. | 70/99 |
| 6,048,001 | A * | 4/2000 | Miller et al. | 292/198 |
| 6,217,087 | B1 * | 4/2001 | Fuller | 292/39 |
| 6,550,824 | B1 * | 4/2003 | Ramsauer | 292/126 |
| 6,616,201 | B1 * | 9/2003 | Liang | 292/207 |
| 6,917,518 | B2 * | 7/2005 | Chen | 361/724 |
| 7,013,687 | B2 * | 3/2006 | Shedd et al. | 70/99 |
| 7,126,066 | B1 * | 10/2006 | Corcino et al. | 200/43.13 |
| 7,543,409 | B2 * | 6/2009 | Higashitani et al. | 49/278 |
| 7,578,531 | B1 * | 8/2009 | Leontaridis | 292/11 |
| 8,083,269 | B2 * | 12/2011 | Mitchell | 292/52 |
| 8,491,022 | B2 * | 7/2013 | Liebel et al. | 292/336.3 |
| 2001/0024039 | A1 * | 9/2001 | Lippoldt et al. | 292/197 |
| 2002/0017120 | A1 * | 2/2002 | Watts et al. | 70/95 |
| 2005/0104388 | A1 * | 5/2005 | Takes | 292/336.3 |
| 2006/0130543 | A1 * | 6/2006 | Alchin et al. | 70/100 |
| 2007/0158956 | A1 * | 7/2007 | Wang et al. | 292/240 |
| 2007/0200370 | A1 * | 8/2007 | Reithmeyer | 292/340 |
| 2008/0129054 | A1 * | 6/2008 | Tremble et al. | 292/33 |
| 2009/0315341 | A1 * | 12/2009 | Willcox | 292/163 |
| 2010/0327612 | A1 * | 12/2010 | Liebel et al. | 292/336.3 |

* cited by examiner

FIG. 1A
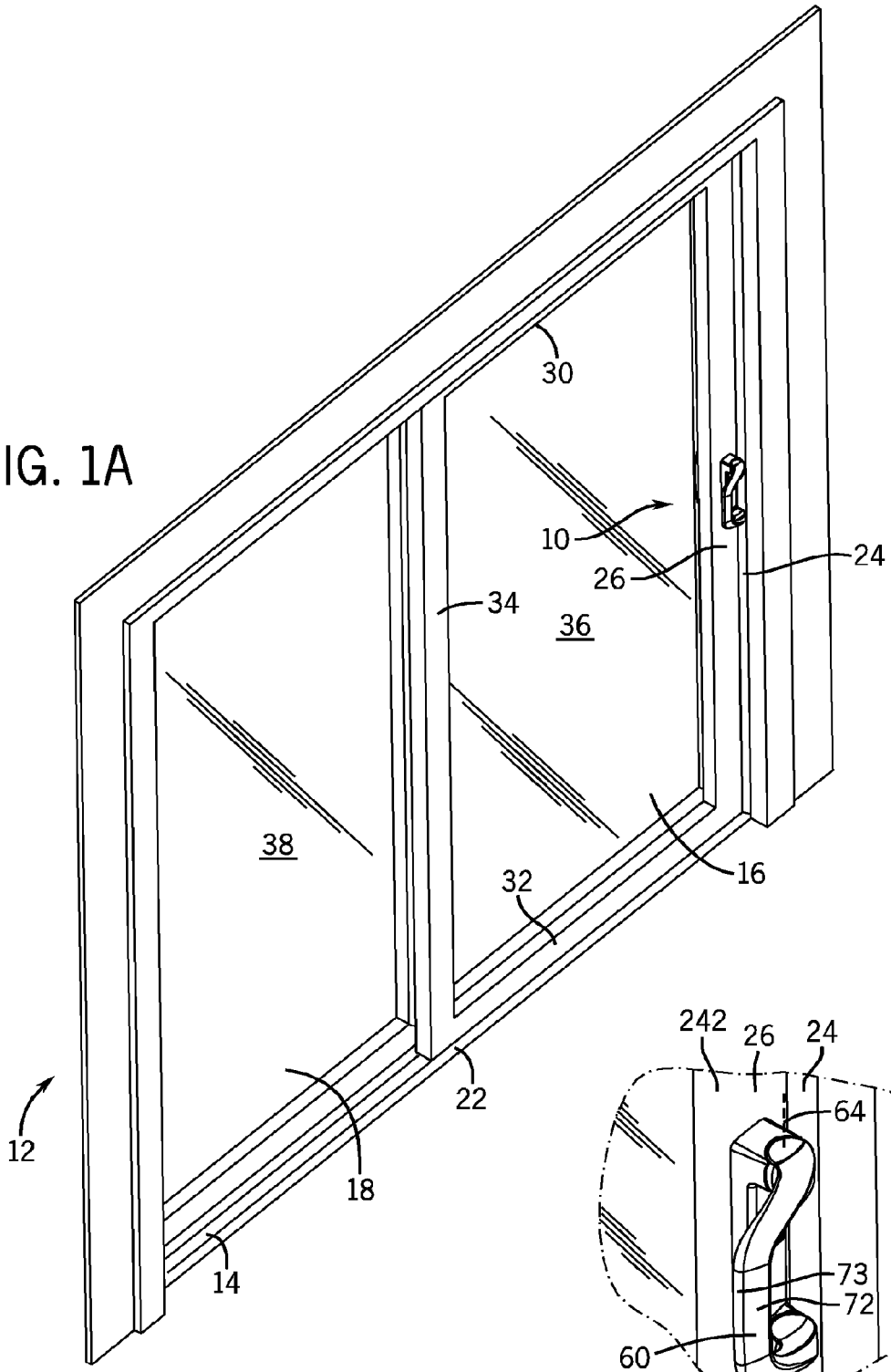
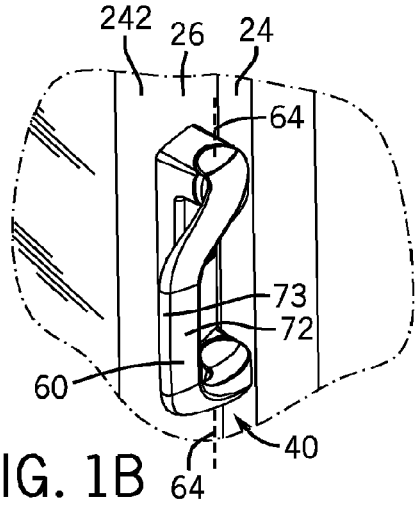
FIG. 1B

FIG. 2A
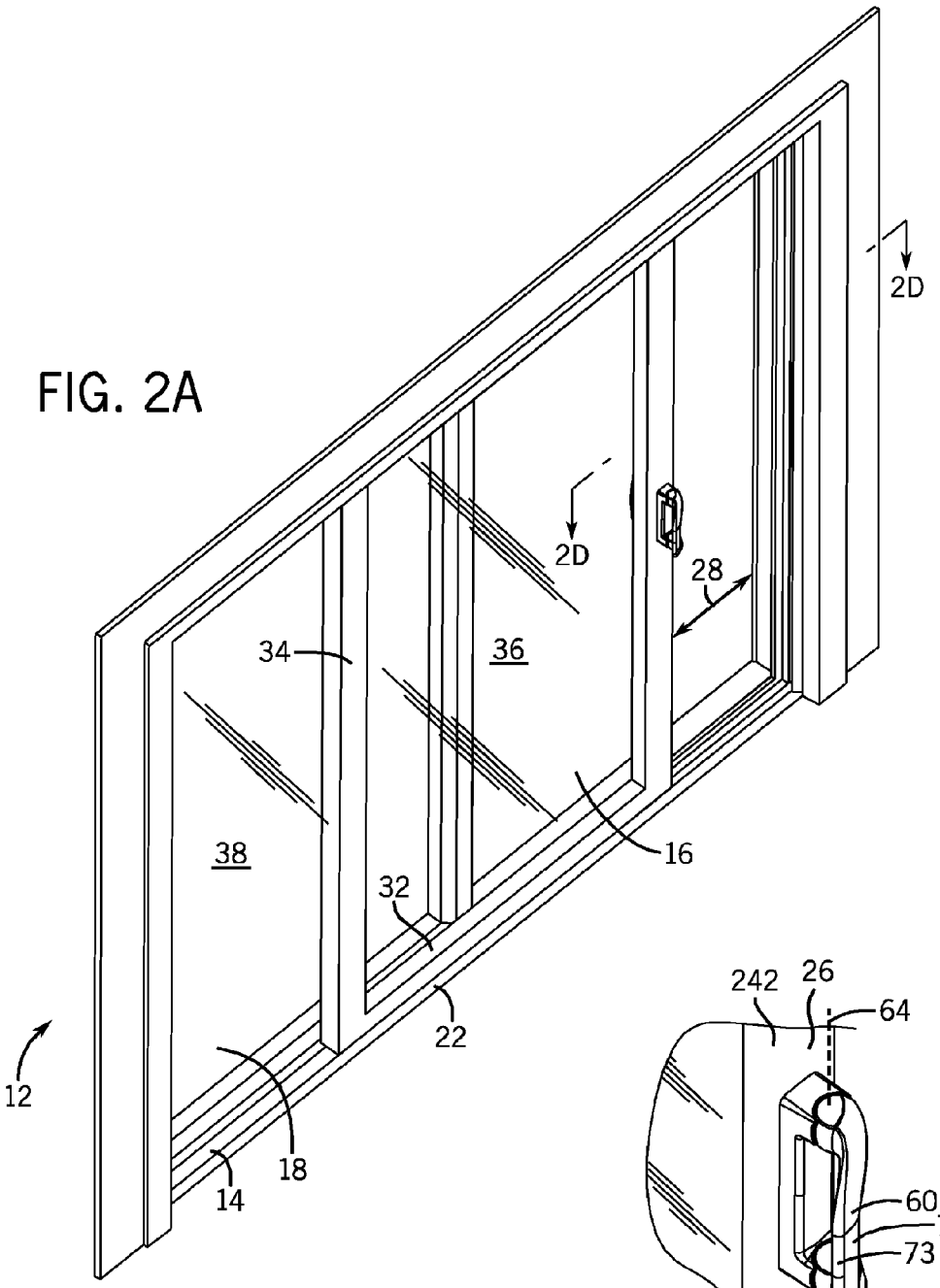
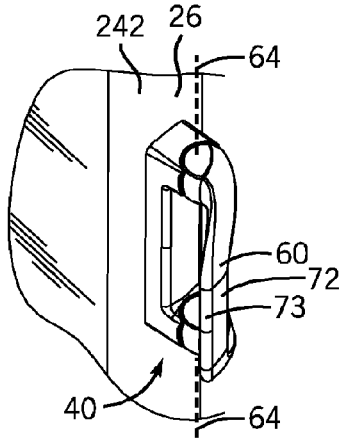
FIG. 2B

FIG. 2C
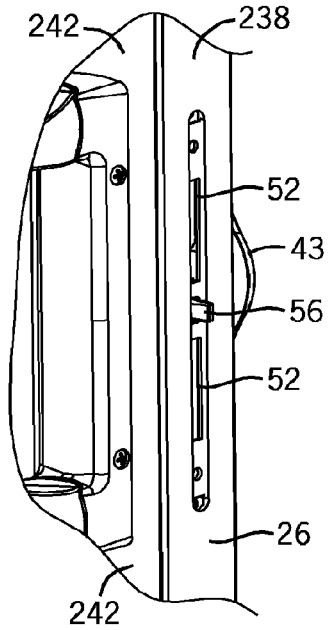
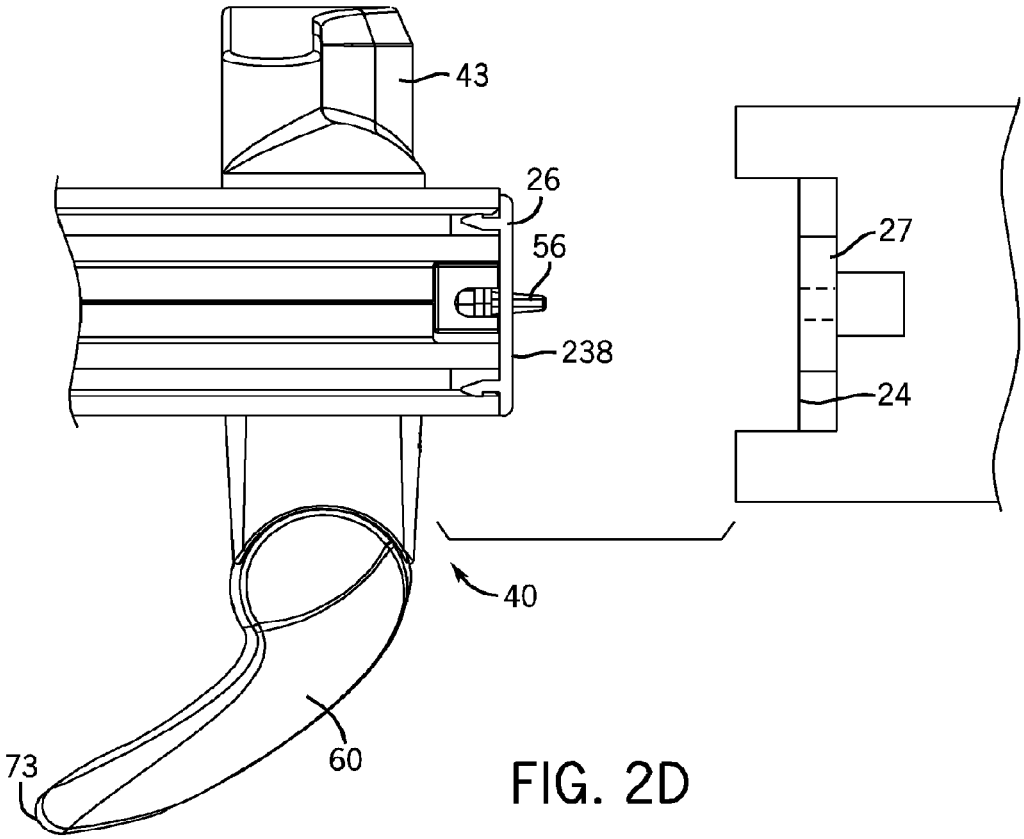
FIG. 2D

SLIDING DOOR HANDLE AND LATCH

CROSS-REFERENCE TO RELATED PATENT APPLICATIONS

This application is a continuation of U.S. Non-Provisional application Ser. No. 12/823,029, filed Jun. 24, 2010, which claims priority from U.S. Provisional Application No. 61/220,506, filed Jun. 25, 2009 and titled "Sliding Door Handle and Latch," which is incorporated herein by reference in its entirety.

BACKGROUND

The present invention relates generally to the field of handles and latches for sliding doors and windows. Sliding doors and windows are opened and closed by sliding the door or window along a track, in contrast to doors and windows utilizing hinges to provide for opening and closing. The handle of a sliding door or window generally provides for opening and closing of the door or window. The latch of a sliding door or window generally provides for locking and unlocking of the door or window. Generally, opening and closing a sliding door or window is a separate operation from locking and unlocking a sliding door or window. For example, a sliding door may include a latch at a first location requiring a user to simultaneously push in and turn the latch in order to unlock the sliding door. The user may then have to move their hand to a second location to grip a handle in order to open and close the sliding door.

SUMMARY

One embodiment of the invention relates to a sliding door latch for use with a sliding door including a first sash having a front surface, the sliding door configured to be opened and closed by opening and closing the first sash relative to a door jamb, the sliding door latch comprising a handle having a gripping portion and a pivotally secured portion defining a handle pivot axis, the handle pivot axis being substantially parallel to and spaced a distance from the front surface of the first sash; a housing operatively connected to the handle; a coupling mechanism secured to the handle; a mortise mechanism operatively coupled to the coupling mechanism, the mortise mechanism including at least one member configured to engage a portion of the door jamb to releasably lock the first sash to the door jamb; and the handle being pivotable about the handle pivot axis from a first position in a direction away from the front surface of the first sash and toward the door jamb to a second position, the handle engaging the coupling mechanism to operatively disengage the at least one member of the mortise mechanism from the door jamb when the handle is moved from the first position to the second position.

Another embodiment of the invention relates to a sliding door latch for use with a sliding door, wherein a mortise mechanism prevents a handle from pivoting from a second position to a first position when the sliding door is open.

Another embodiment of the invention relates to a sliding door latch for use with a sliding door, wherein a handle is pivotable between a first position and a second position only when the sliding door is closed.

Another embodiment of the invention relates to a sliding door latch for use with a sliding door, wherein the sliding door latch provides sufficient frictional forces to prevent a handle from pivoting from a second position to a first position without a force applied by a user when the sliding door is closed.

Another embodiment relates to a sliding door latch for use with a sliding door including a first sash having a front surface, the sliding door configured to be opened and closed by opening and closing the first sash relative to a door jamb, the sliding door latch comprising: a handle having a gripping portion and a pivotally secured portion defining a handle pivot axis, a housing operatively connected to the handle; a mortise mechanism; a coupling mechanism operatively coupling the handle to the mortise mechanism, the coupling mechanism including a pinion and at least a first gear portion fixed relative to the handle; and the handle pivotable at the pivotally secured portion about the handle pivot axis from a first position in a direction away from the front surface of the first sash and toward the door jamb to a second position, the first gear portion being rotated with the pivoting of the handle and operatively moving the pinion, the movement of the pinion operatively disengaging the mortise mechanism from the door jamb thereby unlocking the sliding door; wherein the handle is configured to be pivoted from the first position to the second position by applying a force to the handle that includes a vector component away from the front surface of the first sash and a vector component in the direction opposite the direction to move the first sash from closed to open in order to unlock the sliding door latch and then receive a force in the direction to move the first sash from closed to open in order to open the sliding door; wherein the mortise mechanism maintains the handle in the second position when the sliding door is open.

Another embodiment of the invention relates to a sliding door latch for use with a sliding door, wherein a gear portion is substantially centered and pivotable about a handle pivot axis and a pinion rotates about a pinion axis perpendicular to the handle pivot axis.

Another embodiment relates to a method for operating a sliding door including a first sash having a front surface, comprising: unlocking a sliding door latch by rotating a handle about a handle pivot axis from a first position wherein the sliding door latch is locked and a top side of the handle is at a first angle relative to a front surface of the first sash to a second position wherein the sliding door latch is unlocked and the top side of the handle is at a second angle relative to the front surface of the first sash that is greater than the first angle, by applying a force to handle that includes a vector component away from the front surface of the first sash and a vector component in the direction opposite the direction to move the sliding door from closed to open; opening the sliding door by applying a force to the handle in the direction to move the sliding door from closed to open, separating the first sash from a door jamb; closing the sliding door by applying a force to the handle in the direction to move the sliding door from open to closed; and locking the sliding door latch by pivoting the handle from the second position to the first position.

BRIEF DESCRIPTION OF THE DRAWINGS

FIG. 1A is a perspective view of a sliding door latch according to a first embodiment installed in a sliding door, wherein sliding door latch is locked.

FIG. 1B is an enlarged view of the handle assembly of the sliding door latch of FIG. 1A.

FIG. 2A is a perspective view of the sliding door latch of FIG. 1A installed in a sliding door, wherein sliding door latch is unlocked.

FIG. 2B is an enlarged view of the handle assembly of the sliding door latch of FIG. 2A.

FIG. 2C is an enlarged view of the sliding door latch of FIG. 2A wherein the door jamb is removed FIG. 2D is a cross-sectional view of the sliding door latch of FIG. 2A taken generally along the line 2D-2D.

DETAILED DESCRIPTION

Referring to FIGS. 1A and 2A, a sliding door latch 10 is shown installed in a sliding door 12. Sliding door latch 10 is pivotable between a first or locked position and a second or unlocked position. Sliding door 12 is movable from a first or closed position to a second or open position. For purposes of this application, unless otherwise specified, the front is from the perspective of a user facing sliding door 12 from inside a residence, rear is the direction extending away from the front, the bottom is the direction extending toward or facing the ground, i.e. the surface of the earth, and the top is the direction extending away from the bottom or facing away from the ground. The term right side will refer to the right side as a person facing the sliding door 12 from the interior, though, it should be noted the disclosed sliding door latch may be interior to and/or exterior to the sliding door. In the embodiment in which the sliding door opens from right to left, the term first side will refer to the right side and the term second side will refer to the left side. It should be noted that sliding door latch 10 may be adapted to a slideable window or other slideable devices configured to be moved between a first or locked position and a second or unlocked position.

Figure 1C:
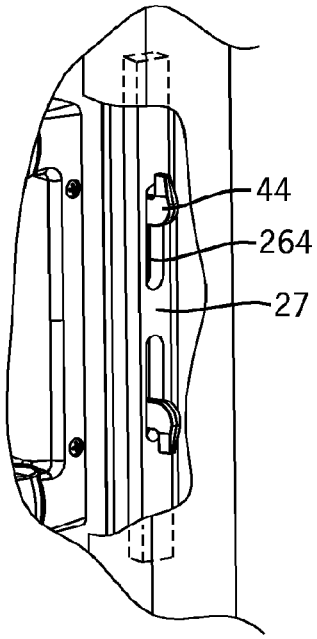
FIG. 1C is an enlarged view of the sliding door latch of FIG. 1A wherein the door jamb is removed.
Figure 1D:
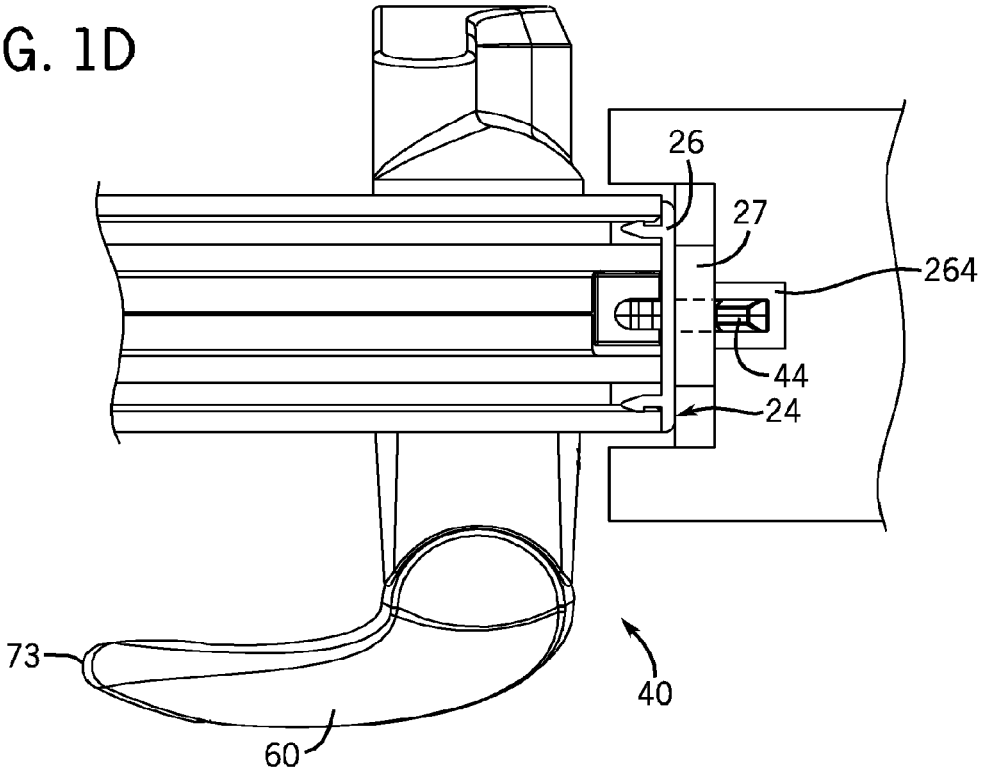
FIG. 1D is a cross-sectional view of the sliding door latch of FIG. 1A taken generally along the line 1D-1D.

Sliding door 12 includes a frame 14, a first sash 16, and a second sash 18. Frame 14 provides support for sliding door 12. First sash 16 and second sash 18 are held upright within frame 14. Frame 14 includes a head and a sill 22 opposite the head. The head and sill 22 are substantially parallel, the head in part defining the top of frame 14 and sill 22 in part defining the bottom of frame 14. Frame 14 further includes a jamb 24 substantially perpendicular to the head and sill 22. First sash 16 includes a lead stile 26. Lead stile 26 of first sash 16 is substantially parallel to jamb 24. When sliding door 12 is in the first or closed position, lead stile 26 of first sash 16 substantially interfaces with jamb 24. Referring to FIGS. 1C and 1D, a strike plate 27 is coupled to jamb 24 along the surface or side that interfaces with lead stile 26 of first sash 16. When sliding door 12 is in the second or open position, lead stile 26 of first sash 16 is separated from jamb 24 such that an opening 28 exists (see FIG. 2A illustrating opening 28). Thus, when sliding door 12 is in the second or open position, people and objects may pass through the sliding door from one space to another space.

First sash 16 further includes a top rail 30, a bottom rail 32, and a second stile 34. First sash 16 is slidably secured between the head and sill 22 and movable along a track from a closed position where sliding door is closed and lead stile 26 substantially interfaces with jamb 24 to an open position where sliding door 12 is open and lead stile 26 is separated from jamb 24. That is, for the purposes of this discussion, the closed and open position of sliding door 12 corresponds with the closed and open position of first sash 16. First sash 16 further includes a substantially planar front surface 36. Second sash includes a substantially planar front surface 38. Second sash 18 is substantially parallel to first sash 16, and substantially planar front surfaces 36 and 38 are substantially parallel.

Referring to FIGS. 1A-1D, sliding door 12 is shown in the closed position and sliding door latch 10 is shown in the locked position. Referring to FIGS. 2A-2D, sliding door 12 is shown in the open position and sliding door latch 10 is shown in the unlocked position.

Figure 3:
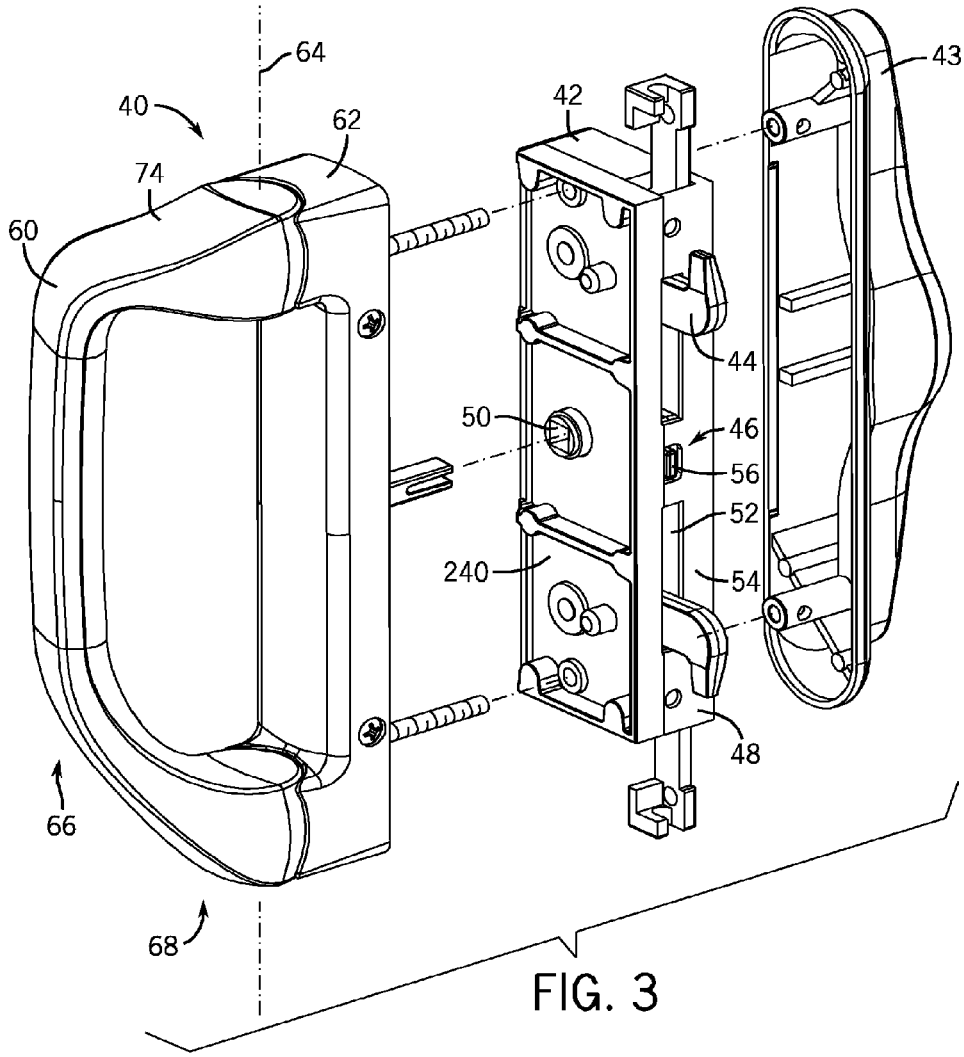
FIG. 3 is an exploded view of the sliding door latch of FIG. 1A.
Figure 4:
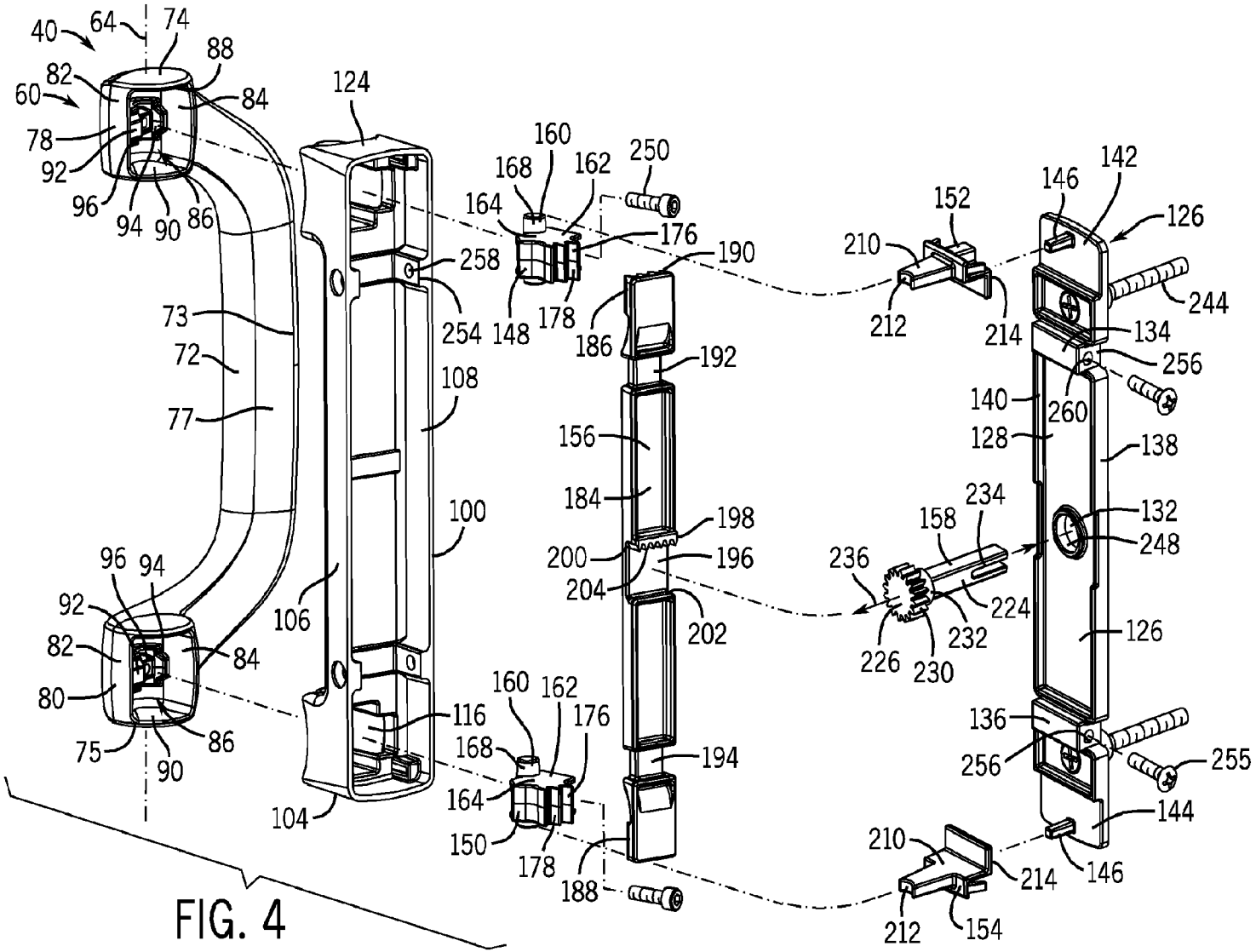
FIG. 4 is an exploded view of the handle assembly of FIG. 1A.

Referring to FIG. 3, sliding door latch 10 includes a handle assembly 40 and a locking mechanism, shown as a mortise mechanism 42. Sliding door latch 10 may further include a second handle 43 for the opposite or rear side of first sash 16. Mortise mechanism 42 may be any number of mortise mechanisms commonly known in the art. For example, the mortise mechanism described in U.S. Pat. No. 5,951,068 may be used. The entire content of U.S. Pat. 5,951,068 is hereby incorporated by reference. In the embodiment shown, mortise mechanism 42 includes a pair of locking elements or engaging members, shown as hooks 44, an anti-slam device 46, a housing 48, a biasing device, and a keyed hole 50.

Mortise mechanism 42 is movable from a first or engaged position to a second or disengaged position. Referring back to FIGS. 1A-1D, when sliding door 12 is closed and sliding door latch 10 is in the locked position, mortise mechanism 42 is in the engaged position. Mortise mechanism 42 engages strike plate 27 and first sash 16 interfaces with and is secured to jamb 24. Hooks 44 (e.g., beaks, etc.) protrude through openings 52 on a first side 54 of housing 48 because of the influence of the biasing device within housing 48. Referring to FIGS. 2A-2D, when sliding door 12 is open and sliding door latch is in the unlocked position, mortise mechanism is in the disengaged position. Hooks 44 are retracted from strike plate 27 into housing 48 as the influence of the biasing device is countered. Anti-slam device 46 includes a tongue 56 which protrudes from housing 48 when mortise mechanism 42 is in the disengaged position. Anti-slam device 46 is configured to prevent sliding door latch 10 from being pivotally moved from the unlocked position to the locked position without an appropriate application of force by a user. Tongue 56 must be pressed toward housing 48 for mortise mechanism 42 to transition from the disengaged position to the engaged position. Specifically, when tongue 56 is depressed inward toward housing 48, hooks 44 may extended through openings 52 by the biasing member such that hooks 44 are engaged with strike plate 27.

Further referring to FIG. 3, handle assembly 40 includes a handle 60 and a housing 62. Handle 60 includes a free end 66 and a pivotally secured portion 68 defining a handle pivot axis 64. Handle pivot axis 64 is substantially parallel to and spaced a distance from front surface 36 of first sash 16. Handle 60 is pivotable about the handle pivot axis 64 from a first position, wherein sliding door latch 10 is locked, to a second position, wherein sliding door latch 10 is unlocked. Referring to FIGS. 1A-D, handle 60 is shown in the first position and sliding door latch 10 is in the locked position. In the locked position a center portion 72 of handle 60 at free end 66 is a first distance from or proximate to sash 36 of sliding door 12. This close proximity of handle 60 to sliding door 12 in the first position provides clearance for window hangings and coverings that may hang in front of sash 36. Referring to FIGS. 2A-D, handle 60 is shown in the second position and sliding door latch 10 is shown in the unlocked position. In the unlocked position, a center portion 72 of handle 60 at free end 66 is a second distance from or distal to sash 36 of sliding door 12. However, in this embodiment, the second distance is greater than the first distance. This difference in distance and orientation of the positions of handle 60 in the locked and unlocked positions provide a visual indication to a user that sliding door latch 10 is locked or unlocked.

Referring to FIGS. 4-6B, handle assembly 40 is shown according to a first embodiment. Handle 60 is operatively coupled to mortise mechanism 42 via coupling mechanism 70. Coupling mechanism 70 facilitates the transfer of motion from handle 60 to mortise mechanism 42.

In the embodiment shown, handle 60 is substantially "U"-shaped, including a gripping portion shown as a central portion 72 having an edge 73. Central portion 72 is shown substantially vertical and configured to be grasped by a user. Central portion 72 is located substantially between a top side 74 and a bottom side 75. Top side 74 and bottom side 75 are shown substantially horizontal, extending substantially perpendicular to central portion 72. Handle 60 further include a front side 76, a rear side 77, a first end 78, and a second end 80. First end 78 and second end 80 are at pivotally secured portion 68 of handle 60 at the ends of top side 74 and bottom side 75. First end 78 and second end 80 are generally opposite central portion 72. First end 78 and second end 80 each include an outer surface 82 that is substantially curved and a cavity 84. Each cavity 84 has a coupling portion 86 located between a top wall 88 and a bottom wall 90. Coupling portion 86 includes a first keyed feature 92, a second keyed feature 94, and a fastener receiving feature 96.

Referring back to FIGS. 1A-1D, sliding door 12, sliding door latch 10, and mortise mechanism 42 are all shown in their respective first positions. Sliding door 12 is shown closed, sliding door latch 10 is shown locked having handle 60 in the first position proximate to first sash 16, and mortise mechanism is shown engaged having hooks 44 protruding through openings 52 on a first side 54 of housing 48, and engaging strike plate 27.

Referring back to FIGS. 2A-2D, sliding door 12, sliding door latch 10, and mortise mechanism 42 are all shown in their respective second positions. Sliding door 12 is shown open, sliding door latch 10 is shown unlocked having handle 60 in the second position distal to first sash 16, and mortise mechanism 42 is shown disengaged having hooks 44 retracted into housing 48 and tongue 56 of anti-slam device 46 protruding from housing 48.

Referring to FIGS. 5A-5B and 6A-6B, housing 62 comprises a top 124 and a base 126. Top 124 and base 126 of housing are configured to receive handle 60 and substantially hold or contain coupling mechanism 70. Housing 62 may be configured in any manner sufficient to receive handle 60 and substantially hold or contain coupling mechanism 70. Housing 62 may further facilitate coupling or securing handle assembly 40 to sliding door 12. In another embodiment, housing may be integral or in part integral with handle 60, mortise mechanism 42, and/or sliding door 12.

Top 124 includes a front side 98, a rear side 100, a top wall 102, a bottom wall 104, a first side wall 106, and a second side wall 108. Front side 98 includes a first handle receiving portion 110 and a second handle receiving portion 112. First handle receiving portion 110 and second handle receiving portion 112 each include a substantially curved surface 114. Substantially curved surface 114 is concave, corresponds to, and receives outer surface 82 of handle 60, which is substantially curved and convex. First handle receiving portion 110 and second handle receiving portion 112 each further include a central aperture 116 and a pair of pivot towers 118. Each pivot tower 118 includes a slot or groove 120 and a wall 122. Walls 122 in-part surround slots 120. Rear side 100 is substantially open to accommodate additional components of handle assembly 40, e.g., coupling mechanism 70.

Base 126 includes a front side 128, an opposing rear side, and an aperture 132. Aperture 132 extends from front side 128 therethrough to rear side. The location of aperture 132 on base 126 substantially corresponds with the location of keyed hole 50 of mortise mechanism 42. Base 126 further includes a first guide 134 and a second guide 136 extending substantially across base 126 from a first side 138 to a second side 140. A top portion 142 and a bottom portion 144 of base 126 each include a pin 146 extending from the front side 128 in a direction away from the rear side, such that the free end of pin 146 is further from the rear side than a base portion of pin 146 that is proximate front side 128.

Further referring to FIGS. 5A-5B and 6A-6B, coupling mechanism 70 includes a first pivotable gear portion 148, a second pivotable gear portion 150, a first closeout support 152, a second closeout support 154, a rack 156, and a pinion 158. In alternative embodiments, coupling mechanism 70 may be any mechanism configured to operatively couple the handle 60 to the mortise mechanism 42.

First pivotable gear portion 148 and second pivotable gear portion 150 each include a handle coupling portion 160, a rack coupling portion 162, a top side 164, and a bottom side 166 substantially parallel to and opposite top side 164. Handle coupling portions 160 each include a pivot 168, a first keyed depression 170, and a second keyed depression 172. Each pivot 168 is substantially cylindrical and substantially vertical, extending along handle coupling portion 160 in part above top side 164 and in part below bottom side 166. First keyed depression 170 is on one side of pivot 168 and second keyed depression 172 is on the other side. Between first keyed depression 170 and second keyed depression 172, a fastener receiving portion 174 in part divides pivot 168, forming a depression therein. Rack coupling portion 162 includes a toothed portion 176. Toothed portion 176 includes a plurality of straight-cut gear teeth 178. First pivotable gear portion 148 and second pivotable gear portion 150 each further include an aperture 180 extending from rack coupling portion 162 through fastener receiving portion 174 of handle coupling portion 160. Each aperture 180 is substantially between top side 164 and bottom side 166 of each pivotable gear portion and is configured to receive a fastener 250 to fix the pivotable gear portions relative to handle 60.

Rack 156 includes a front side 182 and a rear side 184. Front side 182 includes a first toothed portion 186 and a second toothed portion 188 each including a plurality of straight-cut gear teeth 190 extending outward from front side 182 toward handle 60 and away from sliding door 12. First toothed portion 186 is located at the top of front side 182 of rack 156. Second toothed portion 188 is located at the bottom of front side 182 of rack 156, substantially vertically aligned with first toothed portion 186. Rear side 184 includes a first guide-receiving portion 192, a second guide-receiving portion 194, and a pinion receiving portion 196. First guide-receiving portion 192 and second guide-receiving portion 194 are shown as slots or depressions shaped and sized to substantially correspond with first guide 134 and second guide 136, respectively, and allow first guide 134 and second guide 136 to slide therethrough. Pinion receiving portion 196 includes a top wall 198 having a third toothed portion 200 and a bottom wall 202. Third toothed portion 200 includes a plurality of straight-cut gear teeth 204 extending downward from top wall 198 toward bottom wall 202.

First closeout support 152 and second closeout support 154 each include a support 210 having a front surface 212 that is convex. Front surface 212 is configured to correspond to and receive pivot 168. A hole extends from rear surfaces 214 of first closeout support 152 and second closeout support 154 toward front surfaces 212, up into supports 210. Rear surface 214 of first closeout support 152 corresponds to top portion 142 of front side 128 of base 126. The hole of first closeout support 152 receives pin 146 of top portion 142. Rear surface of second closeout portion 154 corresponds to bottom portion 144 of front side 128 of base 126. The hole of second closeout support 154 receives pin 146 of bottom portion 144.

Pinion 158 includes a gear 222 and a shaft 224. Gear 222 includes a front side 226 and a rear side opposite and substantially parallel to front side 226 from which shaft 224 extends perpendicular therefrom. Gear 222 includes a plurality of teeth 230 which are straight-cut gear teeth. Plurality of teeth 230 are configured to mesh with plurality of straight-cut gear teeth 204 of third toothed portion 200 of rack 156. Shaft 224 includes a top portion 232 configured to be received in aperture 132 of base 126 and a keyed portion 234 configured to be received at least in part within keyed hole 50 of mortise mechanism 42. Pinion 158 is rotatable about a pinion axis 236. Pinion axis 236 is substantially perpendicular to handle pivot axis 64, extending inward toward sliding door 12 and outward therefrom.

Referring to FIGS. 1A-6B, the assembly of the sliding door latch will now be discussed according to one embodiment. Mortise mechanism 42 is positioned and secured within lead stile 26 such that first side 54 of mortise mechanism 42 is substantially flush with a first side 238 of lead stile 26. Keyed hole 50 on a front side 240 of mortise mechanism 42 is accessible at a front side 242 of lead stile 26 substantially perpendicular to first side 238. Base 126 is coupled to mortise mechanism 42 with a pair of fasteners 244. The rear side of base 126 substantially interfaces with second side 240 of mortise mechanism 42 and aperture 132 of base 126 is substantially aligned with keyed hole 50. In alternate embodiments, mortise mechanism 42 may be configured and installed in any manner sufficient to be operatively coupled to handle assembly 40 and secure lead stile 26 of first sash 16 to jamb 24.

Pinion 158 is positioned through aperture 132 and at least in part into keyed hole 50 of mortise mechanism 42. Aperture 132 and keyed hole 50 are substantially centered along pinion axis 236. When sliding door latch 10 is assembled and installed in sliding door 12, pinion axis 236 extends back into and forward out of first sash 16, perpendicular to front surface 36. Top portion 232 of shaft is substantially cylindrical and substantially corresponds with an inner surface 248 of aperture 132, helping prevent pinion 158 from wobbling. Keyed portion 234 of shaft 224 is at least in part received in keyed hole 50 such that rotation of keyed portion 234 will result in rotation of keyed hole 50.

First closeout support 152 and second closeout support 154 are coupled to base 126 at top portion 142 and bottom portion 144, respectively. Pin 146 of top portion 142 of base 126 is received in the hole of first closeout support 152. Pin 146 of bottom portion 144 of base 126 is received in the hole of second closeout support 154.

Rack 156 is positioned substantially vertically between first closeout portion 152 and second closeout portion 154. Rack 156 is further positioned between and substantially parallel to first side 138 and second side 140 of base 126. Rear side 184 of rack 156 faces front side 128 of base 126. First guide-receiving portion 192 of rack 156 is aligned with and receives first guide 134 of base 126. Second guide-receiving portion 194 of rack 156 is aligned with and receives second guide 136 of base 126. First guide-receiving portion 192 is configured to be slideable on first guide 134 between first side 138 and second side 140 of base 126, and second guide-receiving portion 194 is configured to be slideable on second guide 136 between first side 138 and second side 140 of base 126. Accordingly, the movement of rack 156 is substantially linear and horizontal. Gear 222 of pinion 158 is received between top wall 198 and bottom wall 202 of pinion receiving portion 196 of rack 156. Third toothed portion 200 of rack 156 is above gear 222 and gravity helps keep the plurality of straight-cut gear teeth 204 of third toothed portion 200 of rack 156 meshed with plurality of teeth 230 of gear 222. Further, the location of gear 222 within portion 196 is maintained by guides 134, 136 within receiving portions 192, 194 respectively. Bottom wall 202 of pinion receiving portion 196 is substantially not in contact with gear 222.

Handle 60 is configured to be pivotally or rotatably coupled to top 124 of housing 62. First end 78 of handle 60 is aligned with first handle receiving portion 110 of top 124. Second end 80 of handle 60 is aligned with second handle receiving portion 112 of top 124. Substantially curved outer surfaces 82 of first end 78 and second end 80 substantially correspond with substantially curved surfaces 114 of first handle receiving portion 110 and second handle receiving portion 112. The curvature of these surfaces facilitates rotation of handle 60 while allowing a close alignment of handle 60 with top 124. Pivot towers 118 of first handle receiving portion 110 are positioned substantially within cavity 84 of first end 78 of handle 60 straddling coupling portion 86, one tower being above coupling portion 86 and one tower being below coupling portion 86. Movement of pivot towers 118 is substantially constrained between top wall 88 and bottom wall 90 of cavity 84 of first end 78, thereby limiting vertical movement of handle 60 relative to top 124. Similarly, pivot towers 118 of second handle receiving portion 112 are positioned substantially within cavity 84 of second end 80 of handle 60 straddling coupling portion 86, one tower being above coupling portion 86 and one tower being below coupling portion 86. Movement of pivot towers 118 is substantially constrained between top wall 88 and bottom wall 90 of cavity 84 of second end 80, thereby limiting vertical movement of handle 60 relative to top 124. Central portions 86 of first end 78 and second end 80 extend toward central aperture 116 of top 124.

First pivotable gear portion 148 and second pivotable gear portion 150 are coupled to handle 60 by fasteners 250. First pivotable gear portion 148 is substantially fixed relative to handle 60 at first end 78, and second pivotable gear portion 150 is substantially fixed relative to handle 60 at second end 80. Pivots 168 are received in slots 120 of towers 118 at top 124, being substantially guided by and constrained within walls 122. Fastener receiving portions 174 of the pivotable gear portions are aligned with fastener receiving features 96 of first end 78 and second end 80. Fasteners 250 are positioned through apertures 180 of pivotable gear portions 148 and 150 and into fastener receiving features 96 of handle 60. Pivots 168 press against walls 122, coupling top 124 to handle 60 by confining top 124 between first end 78 and first pivotable gear portion 148 and second end 80 and second pivotable gear portion 150. Top side 164 and bottom side 166 of each pivotable gear portion 148, 150 are substantially parallel to top wall 88 and bottom wall 90 of cavity 84. First keyed features 92 are received in first keyed depressions 170 and second keyed features 94 are received in second keyed depressions 172, further fixing handle 60 relative to first pivotable gear portion 148 and second pivotable gear portion 150 as well as facilitating the transfer of rotational motion from handle 60 to first pivotable gear portion 148 and second pivotable gear portion 150.

A plurality of tabs 254 at rear side 100 of top 124 are aligned with a plurality of cutouts 256 in base 126 adjacent guides 134, 136. Fasteners 255 pass through apertures 258 on first side wall 106 and second side wall 108 of top 124 and are received in apertures 260 at first side 138 and second side 140 of first guide 134 and second guide 136, respectively, to couple top 124 to base 126. Accordingly, top 124 is fixed relative to base 126 and both are aligned substantially vertically along second side 242 of lead stile 26. Top wall 102 of top 124 substantially corresponds with top portion 142 of base 126, and bottom wall 104 of top 124 substantially corresponds with bottom portion 144 of base 126. Similarly, first side wall 106 of top 124 substantially corresponds with first side 138 of base 126, and second side wall 108 of top 124 substantially corresponds with second side 140 of base 126. In other embodiments, top 124 and base 126 may be coupled using any coupling mechanism known in the art, including, but not limited to, screws, bolts, and snapping mechanisms.

Once top 124 and base 126 are coupled, coupling mechanism 70 is operatively aligned and secured to handle 60. Toothed portion 176 of first pivotable gear portion 148 is aligned with first toothed portion 186 of rack 156. Straight-cut gear teeth 178 of toothed portion 176 mesh with straight-cut gear teeth 190 of first toothed portion 186. Toothed portion 176 of second pivotable gear portion 150 is aligned with second toothed portion 188 of rack 156. Straight-cut gear teeth 178 of toothed portion 176 mesh with straight-cut gear teeth 190 of second toothed portion 188. Further, pivots 168 pivotally interface with front surfaces 212. The portion of pivot 168 above top side 164 of first pivotable gear portion 148 is substantially received by front surface 212 of support 210 of first closeout support 152. Similarly, the portion of pivot 168 below bottom side 166 of second pivotable gear portion 150 is substantially received by front surface 212 of support 210 of second closeout support 154. First closeout portion 152 and second closeout portion 154 substantially occupy the remaining space within slots 120 of pivot towers 118 to secure pivots 168 between front surfaces 212 and wall122 of pivot towers 118. Pivots 168 rotate within the region defined by front surface 212 of the closeout support and the front portion of walls 122.

Referring to the FIGS. 1A-6B, the operation of handle 40 will be discussed. Referring first to FIGS. 1C, the first embodiment of handle assembly 40 is shown in the locked position. In this locked position, free end 66 of handle 60 is a first distance or proximate to first sash 16. Free end 66 of handle 60 is generally closer to front surface 36 of sash 16 in the first position than in the second position. Referring to FIG. 2C when free end 66 of handle 60 is in the first position, the free end 66 is proximate to sash 16. In contrast, referring to FIG. 2D free end 66 is in the second position or distal to sash 16. Referring to FIG. 2B edge 73 of handle 60 is located at the side of central portion 72 between the front and rear of handle 60. In one embodiment, edge 73 is substantially parallel to front surface 36 of sash. Top side 74 and bottom side 75 of handle 60 are at an angle relative to front surface 36 of sash 16. In one embodiment, top and bottom sides 74, 75 are perpendicular to front surface 36 of sash 16. Mortise mechanism 42 is engaged and hooks 44 protrude through opening 52 on first side of mortise mechanism 42 housing 48 into openings 264 of strike plate 27.

While first side 238 of lead stile 26 of first sash 16 is substantially adjacent to jamb 24, free end 66 of handle 60 may be pivoted from the first position proximate to sash 16, wherein sliding door latch 10 is locked, to the second position distal to sash 16, wherein the sliding door latch is unlocked. A user can pivot handle 60 between the first position and the second position by applying a force to handle 60 that includes a vector component both away from front surface 36 of first sash 16 and a vector component opposite the direction to move sliding door 12 from closed to open. The direction opposite the direction to move sliding door 12 from closed to open may also be described as toward jamb 24. For a right handed user facing front surface 36 of first sash 16, pivoting handle 60 from the first position to the second position may involve rotating or pivoting handle 60 substantially to their right, and, depending on their stance, substantially across their body. A user typically grips handle 60 at central portion 72 to apply such a force.

When a user applies the force, including a vector component away from front surface 36 of first sash 16 and a vector component opposite the direction to move sliding door 12 from a closed position to an open position, handle 60 rotates about handle pivot axis 64 from the first position to the second position. The rotation of handle 60 about an axis defined by pivots 168 operatively rotates first pivotable gear portion 148 and second pivotable gear portion 150, which are fixed relative to handle 60 as discussed above. First pivotable gear portion 148 and second pivotable gear portion 150 are rotated through substantially the same angle as handle 60. Pivots 168 rotate within slots 120 of pivot towers 118.

Figure 5B:
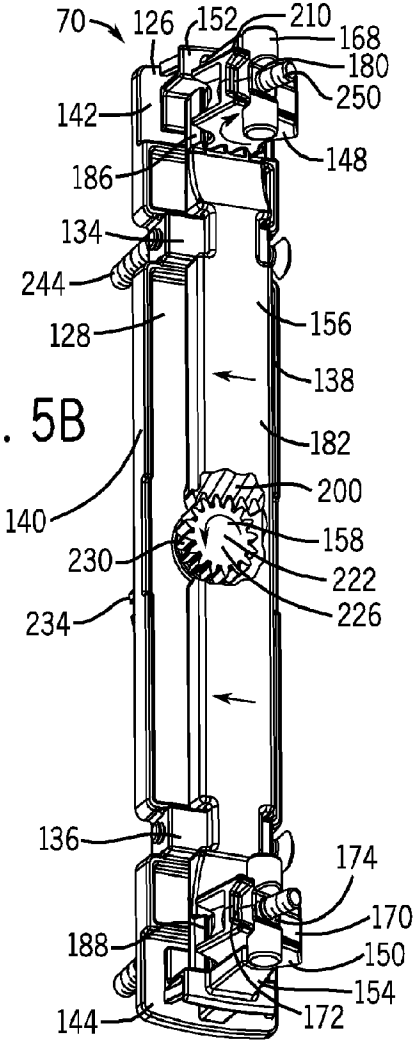
FIG. 5B is an enlarged view of the coupling mechanism and the base of FIG. 5A with a partial cut-away exposing the pinion.
Figure 5A:
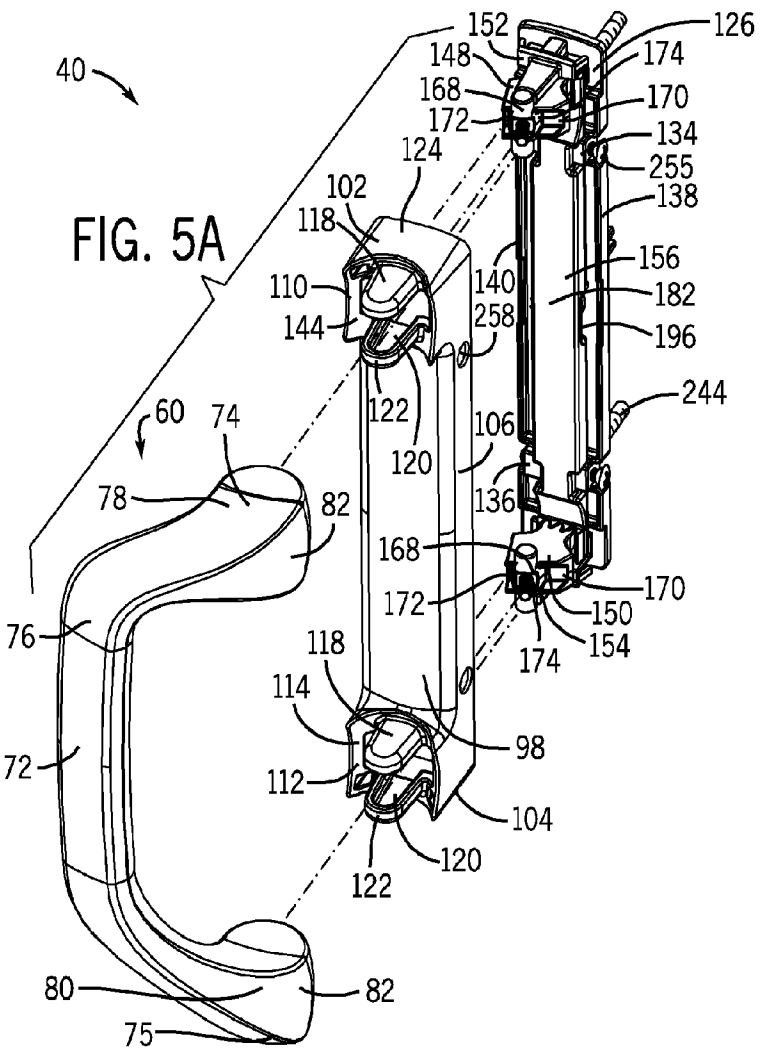
FIG. 5A is a partially exploded view of the handle assembly of FIG. 1 wherein the handle is in the locked position.

Referring to FIGS. 5A-5B, handle 60 is shown in partially exploded and in the first position. When handle 60 is in the first position, rack 156 is substantially vertically aligned along first side 138 of base 126. Rotation of first pivotable gear portion 148 and second pivotable gear portion 150 operatively moves rack 156 linearly from substantially vertically aligned along first side 138 of base 126 to substantially vertically aligned along second side 140 of base 126. Toothed portion 176 of first pivotable gear portion 148 drives first toothed portion 186 of rack 156 toward second side 140 of base 126. Simultaneously, toothed portion 176 of second pivotable gear portion 150 drives second toothed portion 188 of rack 156 toward second side 140 of base 126. First guide-receiving portion 192 of rack 156 slides along first guide 134 and second guide-receiving portion 194 of rack 156 slides along second guide 136. Rack 156 maintains its vertical orientation throughout this linear translation or movement. Thus, rack 156 moves linearly in a direction away from door jamb 24 when handle 60 is pivoted from the first position to the second position. Rack 156 translated linearly in a direction perpendicular to both handle pivot axis 64 and pinion axis 236. This direction is also the direction first sash 16 moves from closed to open.

Third toothed portion 200 of rack 156 rotates pinion 158 as rack 156 is slidably moved from along first side 138 of base 126 to along second side 140 of base 126. Straight-cut gear teeth 204 of third toothed portion 200 of rack 156 drive teeth 230 of gear 222 of pinion 158 such that gear 222 rotates in a counterclockwise direction. Keyed portion 234 of shaft 224 of pinion 158 is in part received within keyed hole 50 of mortise mechanism 42. Rotation of pinion 158 counters the biasing device of mortise mechanism 42, releasing hooks 44 from strike plate 27. Mortise mechanism 42 is thus disengaged and sliding door latch 10 thereby unlocked. Hooks 44 are retracted back into openings 52 of housing 48. Thus, pivoting handle 60 from the first position to the second position causes mortise mechanism 42 to be operatively disengaged.

Sliding door latch 10 may further include resistance forces to maintain handle 60 in the second position, preventing it from pivoting back to the first position without the influence of a user when sliding door 12 is closed. Referring to FIGS. 1A-6B, the assembly of the sliding door latch will now be discussed according to one embodiment Thus, when sliding door 12 is closed, sliding door latch 10 will remain in the second or unlocked position unless and until a user applies the appropriate force to pivot handle 60 back to the first position. In the first embodiment shown, the resistance forces are generated by friction between components of sliding door latch 10 generally. This friction is sufficient to maintain handle in the second position without the influence of a user.

Referring to FIGS. 1D, and 2D, the first embodiment of handle assembly 40 is shown the unlocked position, having free end 66 of handle 60 in the first position, distal to first sash 16. Free end 66 of handle 60 is generally farther from front surface 36 of sash 16 in the second position than in the first position. Edge 73, located at the second side of central portion 72 of handle 60 in the embodiment shown, remains substantially parallel to front surface 36 of first sash 16. Edge 73 is spaced a distance from front surface 36 of sash 16 in the second position greater than in the first position. Referring to FIGS. 1D and 2D top side 74 and bottom side 75 of handle 60 are at an angle relative to front surface 36 of first sash 16 in the second position that is greater than the angle between top side 74 and bottom side 75 relative to front surface 36 of first sash 16 when handle 60 is in the first position. It should be noted that numerous surfaces, features, and edges of handle 60 are similarly at a greater distance from or angle relative to front surface 36 of first sash 16 in the second position than in the first position. While handle 60 pivots about handle pivot axis 64 in the embodiment shown, in other embodiments handle 60 may pivot only in part about a handle pivot axis 64.

Once handle assembly 40 is in the unlocked position, first sash 16 of sliding door 12 may be moved between the closed and the open position. To move sliding door 12 from the closed position to the open position, a user applies a force in the direction of motion that first sash 16 moves to go from the closed position to the open position. This direction is away from jamb 24. This may involve the user pushing handle 60 to open first sash 16.

In this manner, a user may pivot handle 60 between a first locked position and a second unlocked position by rotating handle 60 by applying a force having a vector component away from front surface 36 of first sash 16 and a vector component in direction opposite the direction to move first sash 16 of sliding door 12 from a first or closed position to a second or open position. After pivoting handle 60 from the first position to the second position, there is a transition point or a change in the vector direction of the force applied to handle 60 by the user. Once handle 60 is in the second or unlocked position, the user may apply a force to handle 60 in the direction of the movement of first sash 16 of sliding door 12 from a first or closed position to a second or open position, i.e., away from jamb 24, in order to open sliding door 10. Accordingly, unlocking sliding door latch 10 and opening sliding door 12 involves applying forces to handle 60 that have a substantially opposite force vector component.

There is no need for a user to release any securing or releasing mechanism in addition to pulling and pushing handle 60, e.g., pushing in a button. A user may touch only central portion 72 of handle 60 and be fully capable of operating sliding door latch 10 and sliding door 12. Further, a user need not release handle 60 to fully operate both sliding door latch 10 and sliding door 12. That is a user may unlock the sliding door latch, open the sliding door, close the sliding door, and lock the sliding door latch without releasing the central portion of the handle. This motions is relatively fluid and smooth. Thus, sliding door latch 12 is provides for improved ease of use, even for those persons with limited dexterity.

Figure 6B:
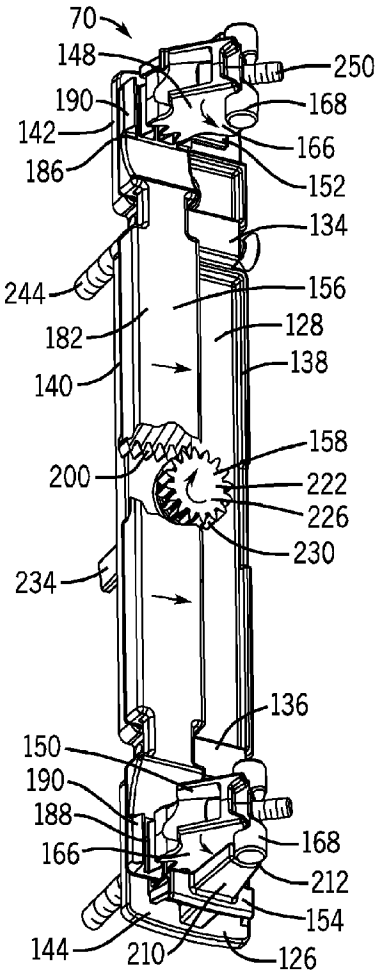
FIG. 6B is an enlarged view of the coupling mechanism and the base of FIG. 6 with a partial cut-away exposing the pinion.
Figure 6A:
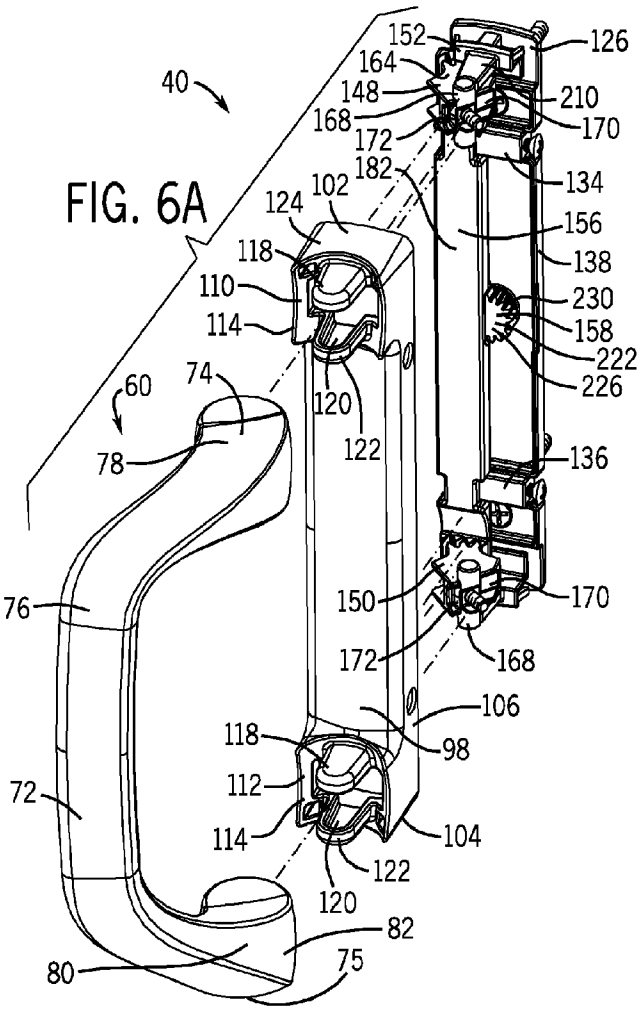
FIG. 6A is a partially exploded view of the handle assembly of FIG. 1A wherein the handle is in the unlocked position.

Referring to FIGS. 6A-6B, handle 60 is shown in partially exploded and in the second position. Handle 60 is configured to remain in the second position whenever sliding door 12 is open. That is, handle 60 cannot be pivotally moved from the second or unlocked position to the first or locked position when sliding door 12 is open. Mortise mechanism 42 is disengaged when handle 60 is in the second position. When mortise mechanism 42 is disengaged, anti-slam device 46 prevents sliding door latch 10 from being pivotally moved from the second or unlocked position to the first or locked position without the appropriate application of force by user. Referring to FIG. 2D, tongue 56 of anti-slam device 46 protrudes from first side 54 of housing 48. Handle 60 is prevented from moving from the second position to the first position until tongue 56 of anti-slam device 46 is pressed toward housing 48 of mortise mechanism 42. Accordingly, anti-slam device 46 also prevents sliding door 12 from being locked unintentionally. Further, by preventing handle 60 from being pivoted to the first position when sliding door 12 is open, anti-slam device 46 prevents damage to sliding door 12 and sliding door latch 10. For example, if handle 60 were to be in the first position when sliding door 12 was open, hooks 44 of mortise mechanism 42 would extend out of housing 48 and could be slammed against frame 14.

To move sliding door 12 from the open position to the closed position, a user applies a force in the direction of motion of first sash 16 as it moves from the open position to the closed position. The direction of this motion is substantially perpendicular to handle pivot axis and toward jamb 24. This may involve a user pulling handle 60 to close first sash 16. Lead stile 26 substantially interfaces with, but is not secured to, jamb 24.

Tongue 56 of anti-slam device 46 is pressed toward housing 48 of mortise mechanism 42 as lead stile 26 nears jamb 24, disengaging anti-slam device 46. However, handle 60 does not automatically move from the second position to the first position when anti-slam device 46 is disengaged. Further, mortise mechanism 42 is not automatically disengaged when anti-slam device 46 is disengaged or lead stile 26 interfaces with jamb 24. A user must apply an appropriate force to pivot handle 60 from the second position to the first position to counter resistance forces maintaining handle 60 in the second position, preventing accidental "lock-outs." According to other embodiments, a biasing element may be provided to force the handle 60 to the second unlocked position once the hooks 44 are withdrawn into mortise mechanism 42. Thus, even when the sliding door is open, a user could apply force to handle 60 to move the handle from the second unlocked position to the locked position. According to some embodiments, the handle returns automatically to the second unlocked position once the user releases the handle.

A user may pivot handle 60 between the second position and the first position by applying a force to handle 60 that includes a vector component in the direction opposite the direction sliding door moves from closed to open and a vector component toward front surface 36 of first sash 16. The direction to move sliding door 12 from the second or open position to the first or closed position may also be described as away from jamb 24. For a right handed user facing front surface 36 of first sash 16, pivoting handle 60 from the second position to the first position typically involves pushing handle 60 to toward the left side of their body and toward front surface 36 of first sash 16. Depending on the user's stance, this motion is substantially across their body. A user typically grips handle 60 at central portion 72 to apply such a force.

In this manner, the user may apply a force in the direction of the movement of first sash 16 from an open position to a closed position toward jamb 24 in order to close sliding door 12. After closing sliding door 12, there is a transition point or a change in the vector direction of the force applied to handle 60 by the user. A user may then pivot handle 60 between the second or unlocked position and the first or locked position by applying a force to 60 having a vector toward front surface 36 of first sash 16 and a vector component in a direction opposite the direction to move sliding door 12 from a second or open position to a first or closed position, i.e., away from jamb 24. Accordingly, closing sliding door 12 and locking sliding door latch 10 involves applying forces to handle 60 that have substantially opposite force vector components. It follows that a user may essentially pull and push handle 60 to both unlock sliding door latch 10 and open sliding door 12, and a user may essentially pull and push handle 60 to close sliding door 12 and lock sliding door latch 10.

There is no need for a user to release any securing or releasing mechanism in addition to pulling and pushing handle 60, e.g., pushing in a button. A user may touch only central portion 72 of handle 60 only and be fully capable of operating sliding door latch 10 and sliding door latch 12. Further, a user need not release handle 60 to fully operate both sliding door latch 10 and sliding door 12. Thus, sliding door latch 12 is provides for improved ease of use, even for those persons with limited dexterity.

When a user pivotally moves handle 60 from the unlocked position to the locked position, handle 60 again pivots about handle pivot axis 64. As free end 66 of handle 60 is moved back toward front surface 36 of first sash 16 of sliding door 12 and away from jamb 24, rack coupling portions 162 of first pivotable gear portion 148 and second pivotable gear portion 150 are operatively rotated by handle 60. Handle 60 operatively rotates first pivotable gear portion 148 and second pivotable gear portion 150 through substantially the same angle as handle 60. Pivots 168 rotate within slots 120 of pivot towers 118. The rotation of first pivotable gear portion 148 and second pivotable gear portion 150 operatively translates or moves rack 156 from a position substantially vertically aligned along second side 140 of base 126 to a position substantially vertically aligned along first side 138 of base 126. Thus, rack 156 moves linearly in a direction toward doorjamb 24 when handle 60 is pivoted from the second position to the first position. Toothed portion 176 of first pivotable gear portion 148 drives first toothed portion 186 of rack 156 and toothed portion 176 of second pivotable gear portion 150 drives second toothed portion 188 of rack 156. First guide-receiving portion 192 slides along first guide 134 and second guide-receiving portion 194 slides along second guide 136, translating rack 156 linearly towards door jamb 24. Rack 156 maintains its substantially vertical orientation throughout this translation.

Third toothed portion 200 rotates pinion 158 as rack 156 is slidably moved from along second side 140 of base 126 to along first side 138 of base 126. Straight-cut gear teeth 204 of third toothed portion 200 exert a force on teeth 230 of gear 222, driving gear 222 to rotate clockwise. Keyed portion 234 of shaft 224 of pinion 158 rotates within keyed hole 50 of mortise mechanism 42, releasing biasing device and engaging mortise mechanism 42. Hooks 44 engage strike plate 27. Thus, pivoting handle 60 from the second position to the first position causes mortise mechanism 42 to be operatively engaged. Sliding door latch 10 is locked and sliding door 12 is secured in the closed position.

As discussed above, rotation of handle 60 operatively disengages and engages mortise mechanism 42. In the first embodiment shown in FIGS. 1A-6B, rotational motion of handle 60 is translated into linear motion, and then back into rotational motion. The rotation of handle 60 about a handle pivot axis 64 causes pinion 158 to rotate about pinion axis 236. Pinion axis 236 is substantially perpendicular to handle pivot axis 64. Thus, rotational movement of handle 60 about handle pivot axis 64 is translated into rotational motion about an axis perpendicular to handle pivot axis 64.

Referring to FIGS. 7A-9B, handle assembly 40 is shown according to a second embodiment. Handle 60 is operatively coupled to mortise mechanism 42. Coupling mechanism 70 is secured to handle 60 and facilitates the transfer of motion from handle 60 to mortise mechanism 42.

In the second embodiment shown, handle 60 is shown substantially rectangular, including a first side 400, a second side 401, a top side 402, a bottom side 404, a front side 406, and a rear side 408. Second side 401 is at free end 66 and includes a gripping portion 409 configured to be grasped by the user. First side 400 is at pivotally secured portion 68. Rear side 408 of first side 401 includes a pair of pivots 410. One pivot 410 extends in part above top side 402 and the other pivot 410 extends in part below bottom side 404. Pivots 410 are substantially vertically aligned along handle pivot axis 64. Top side 402 includes an outer surface 412 and an angled edge 414. Bottom side 404 includes an outer surface 416 and an angled edge 418. Angled edge 414 is angled from the rear edge of top side 402 toward pivots 410 at pivotally secured portion 68. Angled edge 418 is angled from the rear edge of bottom side 404 toward pivots 410 at pivotally secured portion 68. Rear side 408 further includes a ridge 422 coupled to first side 400 having a first surface 424 in part defining a central opening 426 in handle 60, a second surface 428 substantially opposite first surface 424, and a third surface 430. Handle 60 further includes an first edge 420 that is shown substantially vertical.

Figure 7A:
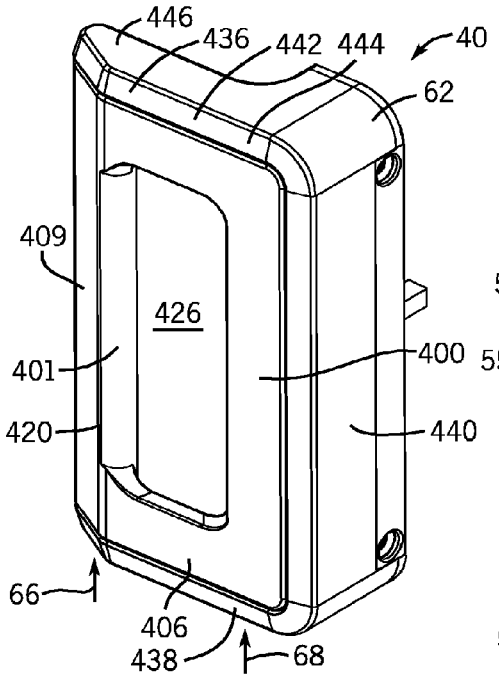
FIG. 7A is a front perspective view of the sliding door latch according to a second embodiment in the locked position.
Figure 7B:
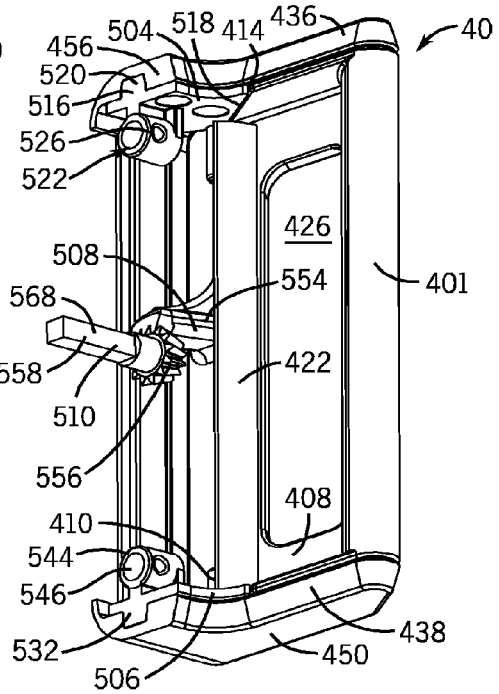
FIG. 7B is a rear perspective view of the sliding door latch of FIG. 7A with the base removed.

Referring to FIGS. 7A-7B, handle assembly 40 is shown in the first or locked position. In this position, front side 406 of handle 60 is substantially parallel to front surface 36 of first sash 16. Mortise mechanism 42 is engaged. Hooks 44 protrude through opening 52 on a first side 54 of housing 48, engaging strike plate 27.

Referring back to FIGS. 7A-9B, housing 62 comprises a bezel 432 and a base 434. Bezel 432 includes a top side 436, a bottom side 438, a first side wall 440, and front surface 442 substantially defining a rim 444 that substantially corresponds with handle 60. Top side 436 includes an outer surface 446 and an inner surface 448. Bottom side 438 includes an outer surface 450 and an inner surface 452. Inner surface 448 of top side 436 and inner surface 452 of bottom side 438 each include a slot 454. Slots 454 are open at a rear surface 456 of bezel 432 and extend substantially toward front surface 442 of bezel 436. First side wall 440 substantially extends between top side 436 and bottom side 438 on the side of handle 60 closest to jamb 24.

Figure 9A:
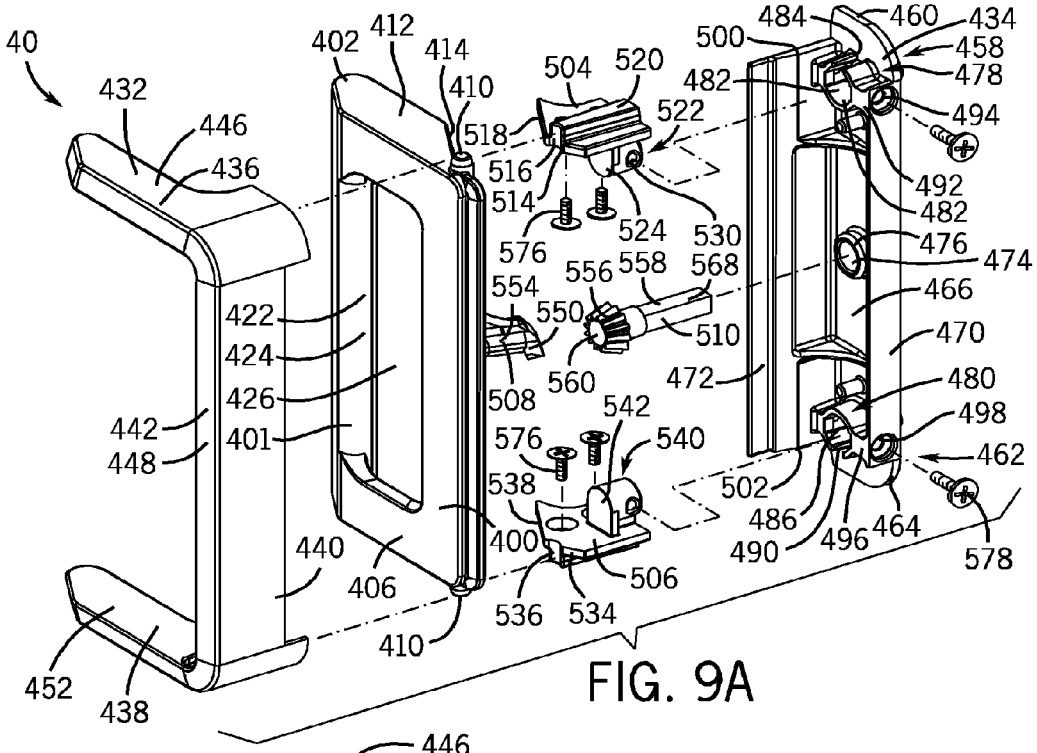
FIG. 9A is a front perspective exploded view of the sliding door latch of FIG. 7A.
Figure 9B:
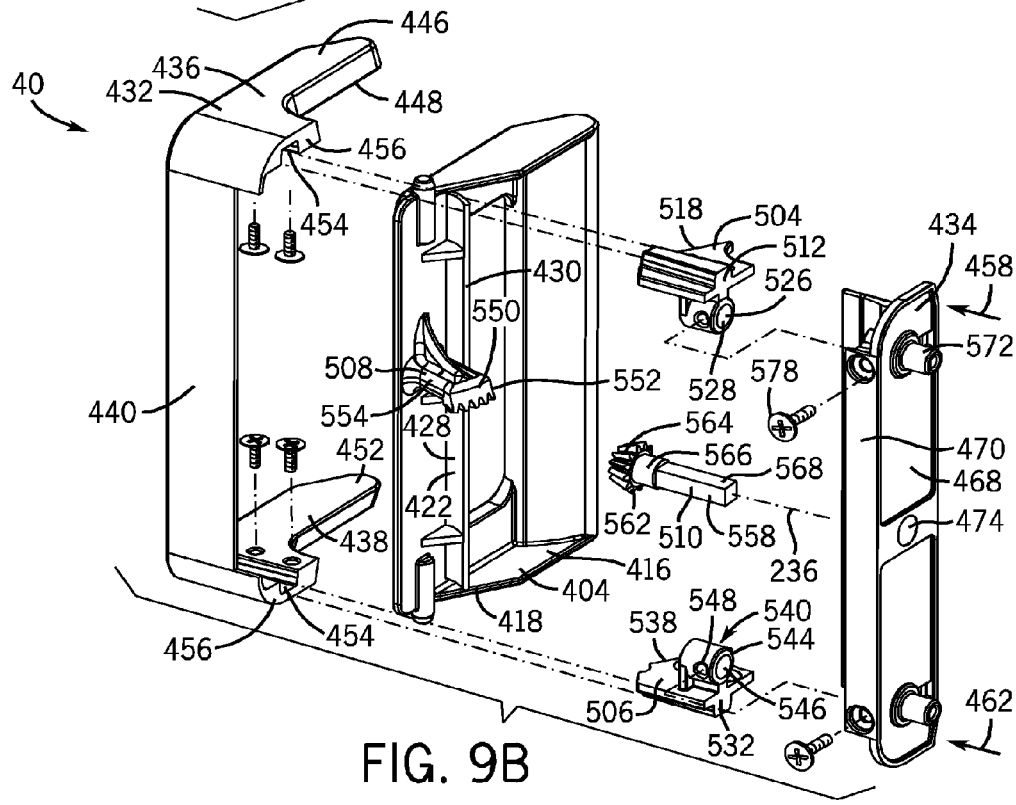
FIG. 9B is a rear perspective exploded view of the sliding door latch of FIG. 7A.

Referring to FIGS. 9A-9B, base 434 includes a top portion 458 having a top edge 460, a bottom portion 462 having a bottom edge 464, a front side 466, a rear side 468, a first side wall 470, a second side wall 472, and an aperture 474 having a rim 476. Aperture 474 extends from front side 466 therethrough to rear side 468. The location of aperture 474 substantially corresponds with the location of keyed hole 50 of mortise mechanism 42. Second side wall 472 includes a top surface 500 and a bottom surface 502.

Base 434 further includes a first receiving portion 478 at top portion 458 and a second receiving portion 480 at bottom portion 462. First receiving portion 478 defines a cavity 482 and includes an opening 484 facing top edge 460. First receiving portion 478 further includes a front side 492 and an aperture 494 extending from first side wall470 into cavity 482. Second receiving portion 480 defines a cavity 486 and includes an opening 490 facing bottom edge 464. Second receiving portion 480 further includes a front side 496 and an aperture 498 extending from first side wall 470 into cavity 486.

In the second embodiment shown, coupling mechanism 70 includes a first closeout portion 504, a second closeout portion 506, a partial gear portion 508, and a pinion 510. In alternative embodiments, coupling mechanism 70 may be any mechanism configured to operatively couple the handle 60 to the mortise mechanism 42.

First closeout portion 504 includes a rear side 512 and a front side 514. The front side 514 has a concave surface 516 configured to correspond with one of pivots 410 and an angled surface 518 configured to correspond with angled edge 414 of top side 402. Angled surfaces 518 and 538 may be configured prevent handle 60 from being pivoted toward front surface 36 of first sash 16 when handle 60 is already in the first or locked position. Concave surface 516 is at the front of a support 520 extending from rear side 512 to front side 514. First closeout portion 504 further includes a first received portion 522 that is substantially cylindrical, corresponding with cavity 482 of first receiving portion 478. First received portion 522 includes a front surface 524 and a rear surface 526 that substantially corresponds with, e.g., is substantially planar with, rear side 512. Rear surface 526 includes an opening 528. First received portion 522 further includes an aperture 530 perpendicular to opening 528 extending vertically therethrough.

Second closeout portion 506 includes a rear side 532 and a front side 534. The front side 534 having a concave surface 536 configured to correspond with one of pivots 410 and an angled surface 538 configured to correspond with angled edge 418 of bottom side 404. Second closeout portion 506 further includes a second received portion 540 that is substantially cylindrical, corresponding with cavity 486 of second receiving portion 480. Second received portion 540 includes a front surface 542 and a rear surface 544 that substantially corresponds with, e.g., is substantially planar with, rear side 532. Rear surface 544 includes an opening 546. Second received portion 540 further includes an aperture 548 perpendicular to opening 528 extending vertically therethrough.

Partial gear portion 508 is shown coupled to rear side 408 of handle 60. Partial gear portion 508 includes a toothed portion 550 having a plurality of teeth 552 and is positioned at the rear side of a column 554. Toothed portion 550 is centered along handle pivot axis 64. Plurality of teeth 552 are bevel-cut teeth. Partial gear portion 508 is fixed relative to handle 60.

Pinion 510 includes a gear 556 and a shaft 558. Gear 556 includes a front side 560 and a rear side 562 from which shaft 558 extends perpendicular thereto. Gear 556 includes a plurality of teeth 564 which are bevel-cut gear teeth. Plurality of teeth 564 are configured to mesh with plurality of teeth 552 of partial gear portion 508. Shaft 558 includes a top portion 566 configured to be received in aperture 474 of base 434 and a keyed portion 568 configured to be received at least in part within keyed hole 50 of mortise mechanism 42. Pinion 510 is rotatable about a pinion axis 236 that is substantially perpendicular to handle pivot axis 64.

Referring to FIGS. 7A-9B, the assembly of the sliding door latch will now be discussed according to the second embodiment. Mortise mechanism 42 is positioned and secured within lead stile 26 of first sash 16 such that first side 54 of mortise mechanism 42 is substantially flush with first side 238 of lead stile 26. Keyed hole 50 on a second side 240 of mortise mechanism 42 is substantially accessible at second side 242 of lead stile 26 substantially perpendicular to first side 238. Base 434 is coupled to mortise mechanism 42 with a pair of fasteners 572. Rear side 468 of base 434 substantially interfaces with second side of mortise mechanism 42 and aperture 474 is substantially aligned with keyed hole 50.

Pinion 510 is positioned through aperture 474, keyed portion 568 of shaft 558 extending at least in part into keyed hole 50 of mortise mechanism 42. Aperture 474 and keyed hole 50 are substantially centered along pinion axis 236. Pinion axis 236 extends back into and forward out of first sash 16, perpendicular to substantially planar front surface 36. Top portion 566 of shaft 558 is substantially cylindrical and substantially corresponds to aperture 474, helping prevent pinion 158 from wobbling. Rear side 562 of gear 556 substantially interfaces with rim 476 of aperture 474.

Handle 60 is coupled to bezel 432. Pivots 410 of handle 60 are received in slots 454 of bezel 432. Outer surface 412 of top side 402 of handle 60 is substantially aligned with and parallel to inner surface 452 of top side 436 of bezel 432. Outer surface 416 of bottom side 404 of handle 60 is substantially aligned with and parallel to inner surface 452 of bottom side 438 of bezel 432. Edge 420 of handle 60 is in part covered by rim 444 of front surface 442 of bezel 432.

First closeout portion 504 is received in slot 454 of top side 436 of bezel 432 after handle 60 is received. Support 520 is configured to substantially closeout the portion of slot 545 remaining portion open or unfilled. Pivot 410 on top side 402 of handle 60 is pushed toward front side 466 of bezel 432 by first closeout portion 504 and received by concave surface 516. Rear side 512 of first closeout portion 504 is substantially flush with rear surface 456 of bezel 432. Similarly, second closeout portion 506 is received in slot 454 of bottom side 438 of bezel 432 after handle 60. Support 520 is configured to closeout the remaining portion of slot 454. Pivot 410 on bottom side 404 of handle 60 is pushed toward front side 466 of bezel 432 by second closeout portion 506 and received by concave surface 536. Rear side 532 of second closeout portion 506 is substantially flush with rear surface 456 of bezel 432.

First closeout portion 504 and second closeout portion 506 are secure ably coupled to inner surfaces 452 of bezel 432 with fasteners 576. Handle 60 is rotatably secured within bezel 432 via pivots 410 once first closeout portion 504 and second closeout portion 506 are secured to bezel 432.

Handle 60 and bezel 432 are coupled to base 434 via first closeout portion 504 and second closeout portion 506. First received portion 522 of first closeout portion 504 is received within cavity 482 of first receiving portion 478 of base 434. Second received portion 540 of second closeout portion 506 is received within cavity 486 of second receiving portion 480 of base 434. Aperture 530 of first received portion 522 is aligned with aperture 494 of first side wall 470 of base 434. Aperture 548 of second received portion 540 is aligned with aperture 498 of first side wall 470 of base 434. Fasteners 578 secure first received portion 522 in first receiving portion 478 and second received portion 540 in second receiving portion 480.

First side wall 440 of bezel 432 is substantially aligned first side wall 470 of base 434, forming a uniform exterior wall on the side of handle assembly 40 nearest door jamb 24. Second side wall 472 of base 434 and rim 444 of handle 60 correspond, in part defining central opening 426. Toothed portion 550 of partial gear portion 508 is aligned with gear 556. Teeth 552 of partial gear portion 508 mesh with teeth 564 of gear 556 of pinion 510. Teeth 552 and teeth 564 are bevel-cut teeth. As mentioned above, partial gear portion 508 is centered about handle pivot axis 64 and fixed relative thereto. Pinion 510 rotates about pinion axis 236. Pinion axis 236 is substantially perpendicular to handle pivot axis 64.

Referring to FIGS. 7A-8B, the operation of handle 40 according to the second embodiment will be discussed.

Handle assembly 40 is shown in the first or locked position in FIGS. 7A-7B, having free end 66 of handle 60 proximate to sliding door 12. Free end 66 of handle 60 is generally closer to front surface 36 of first sash 16 in the first position than in the second position Front side 406 of handle 60 is substantially flush with front surface 442 of bezel 432. Front side 406 of handle 60 is also substantially parallel to and spaced a distance from front surface 36 of first sash 16. Top side 402 and bottom side 404 are at an angle relative to front surface 36 of sash 16. Further, angled edges 414 and 418 are at an angle relative to front surface 36 of first sash 16 and substantially interface with angled surfaces 518 and 538 of first closeout portion 504 and second closeout portion 506, respectively. Mortise mechanism 42 is engaged and hooks 44 protrude through opening 52 on first side of mortise mechanism 42 housing 48 into strike plate 27, securing lead stile 26 of first sash 16 to jamb 24.

When, first side 238 of lead stile 26 of first sash 16 is substantially interfacing with and secured jamb 24, free end 66 of handle 60 may be pivoted from the first or locked position to the second or unlocked/position. A user can pivot handle 60 between the first position and the second position by applying a force to handle 60 that includes a vector component both away from front surface 36 of first sash 16 and a vector component opposite the direction to move sliding door 12 from a first or closed position to a second or open position. The direction to move sliding door 12 from a closed position to an open position may also be described as toward jamb 24. For a right handed user facing front surface 36 of first sash 16, pivoting handle 60 from the first position to the second position may involve pulling or pivoting handle 60 substantially to their right, and, depending on their stance, substantially across their body. A user typically grips handle 60 at central portion 72 to apply such a force.

In the locked position, front side of handle 60 is substantially flush with front surface 442 of bezel 432. When a user applies the force including a vector component both away from front surface 36 of first sash 16 and a vector opposite the direction to move sliding door 12 from a closed position to an open position, handle 60 rotates or pivots about handle pivot axis 64 from the first position to the second position. Pivoting handle 60 operatively rotates partial gear portion 508, which is fixed relative to handle 60. Partial gear portion rotates 508 about handle pivot axis 64. Partial gear portion 508 operatively rotates pinion 510. As handle and partial gear portion 508 are rotated, gear 556 rotates. Plurality of teeth 552 of toothed portion 550 of partial gear portion 508 drive teeth 564 of gear such that pinion 510 rotates counterclockwise. Keyed portion 568 of shaft 558 of pinion 510 rotates keyed hole 50, engaging mortise mechanism 42. Hooks 44 are released from strike plate 27 and swinging back into openings 52 of housing 48. Thus, pivoting handle 60 from the first position to the second position causes mortise mechanism 42 to be operatively disengaged. Sliding door latch 10 is unlocked and closed as lead stile 26 of first sash 16 substantially interfaces with, but is not secured to, jamb 24.

Sliding door latch 10 may further include resistance forces to maintain handle 60 in the second position, preventing it from pivoting back to the first position without the influence of a user. These resistance forces may be present because of sliding door latch 10 or one or more components thereof, e.g., coupling mechanism 70 or an additional mechanism generally configured to maintain the handle in the second position when the sliding door is closed. Thus, when sliding door 12 is closed, sliding door latch 10 will remain in the second or unlocked position unless and until a user applies the appropriate force to pivot handle 60 back to the first position. In the first embodiment shown, the resistance forces are generated by friction between components of sliding door latch 10 generally. This friction is sufficient to maintain handle in the second position without the influence of a user.

Once handle assembly 40 is in the second or unlocked position, first sash 16 of sliding door 12 may be in the closed position, the open position, or moved between the closed and the open position. To move sliding door 12 from the closed position to the open position, a user applies a force in the direction of motion of first sash 16 as it moves from the closed position to the open position. This direction is away from jamb 24. This may involve the user pushing handle 60 to open first sash 16.

In this manner, a user may pivot handle 60 between a first position wherein sliding door latch 10 is locked and a second position wherein sliding door latch is unlocked by pivoting or applying a force to handle 60 having a vector component away from front surface 36 of first sash 16 and a vector component in the direction opposite the direction to move first sash 16 of sliding door 12 from a closed position to an open position. After pivoting handle 60 from the first position to the second position, there is a transition point or a change in the vector direction of the force applied to handle 60 by the user. Once handle 60 is in the second position, the user may apply a force to handle 60 in the direction of the movement of first sash 16 of sliding door 12 from a first or closed position to a second or open position, i.e. away from jamb 24, in order to open sliding door 12. Accordingly, unlocking sliding door latch 10 and opening sliding door 12 involves applying forces to handle 60 that have substantially opposite force vector components.

There is no need for a user to release any securing or releasing mechanism in addition to pulling and pushing handle 60, e.g., pushing in a button. A user may touch only second side 401, e.g., at gripping portion 409, of handle 60 and be fully capable of operating sliding door latch 10 and sliding door latch 12. Further, a user need not release handle 60 to fully operate both sliding door latch 10 and sliding door 12. Thus, sliding door latch 12 is provides for improved ease of use, even for those persons with limited dexterity Referring back to FIG. 2C, handle 60 is configured to remain in the second position whenever sliding door 12 is open. That is, handle 60 cannot be moved from the second or unlocked position to the first or locked position when sliding door 12 is open. Mortise mechanism 42 is disengaged when handle 60 is in the second position. When mortise mechanism 42 is disengaged, anti-slam device 46 prevents handle 60 of sliding door latch 10 from being pivoted from the second position to the first position without the appropriate force applied by a user. Tongue 56 of anti-slam device 46 protrudes from first side 54 of housing 48. Handle 60 cannot be pivotally moved from the second position to the first position until tongue 56 of anti-slam device 46 is pressed toward housing 48 of mortise mechanism 42. Anti-slam device 46 prevents sliding door 12 from being locked unintentionally. By preventing handle 60 from being pivoted to the first position when sliding door 12 is open, anti-slam device 46 also prevents damage to sliding door 12 and sliding door latch 10. For example, if handle 60 were to be in the first position when sliding door 12 was open, hooks 44 of mortise mechanism 42 would extend from housing 48 and could be slammed against frame 14.

Figure 8A:
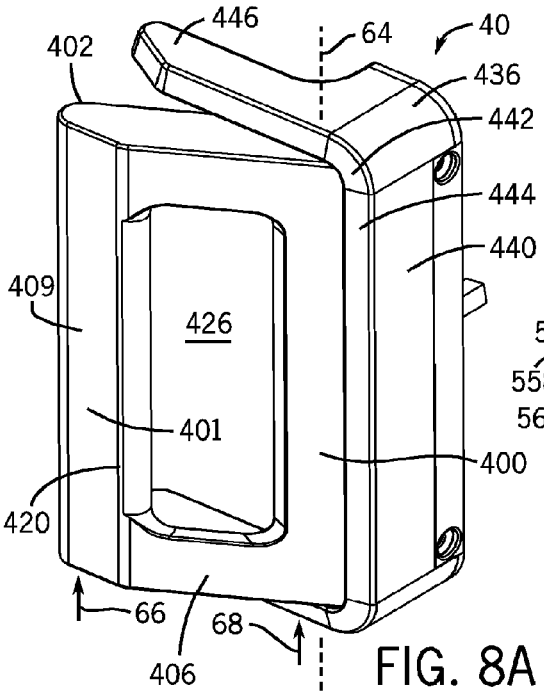
FIG. 8A is a front perspective view of the sliding door latch of FIG. 7A in the unlocked position.
Figure 8B:
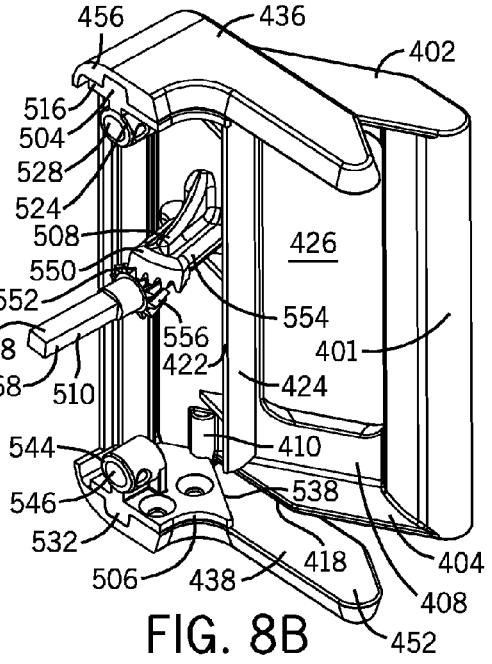
FIG. 8B is a rear perspective view of the sliding door latch of FIG. 8A wherein the base is removed.

Handle assembly 40 is shown in the unlocked position in FIGS. 8A-8B, having free end of handle 60 distal to front surface 36 of first sash 16. Free end 66 of handle 60, including gripping portion 409, is generally farther from front surface 36 of first sash 16 in the second or unlock position than in the first or locked position. Front side 406 of handle 60 is at an angle relative to front surface 442 of bezel 432. Front side 406 of handle 60 is generally spaced a greater distance from front surface 36 of first sash 16 in the second position than in the first position. Front side 406 of handle 60 is at an angle relative to front surface 442 of bezel 432. Top side 402 and bottom side 404 are and at an angle relative to front surface 36 of first sash 16 in the second position that is greater than the angle of top side 402 and bottom side 404 relative to front surface 36 of first sash 16 in the first position. Angled edges 414 and 418 are also at an angle relative to front surface 36 of first sash 16 in the second position greater than in the first position. Further, angled edges 414 and 418 no longer interface with angled surfaces 518 and 538, which are substantially fixed and immovable relative to bezel 432 and front surface 36 of first sash 16. It should be noted that numerous surfaces, features, and edges of handle 60 are similarly at a greater distance from or angle relative to front surface 36 of first sash 16 in the second position than in the first position. Further, while handle 60 pivots about handle pivot axis 64 in the embodiment shown, in other embodiments handle 60 may only in part pivot about a handle pivot axis 64.

To lock sliding door latch 10 once sliding door 12 has been opened, sliding door 12 is both closed and handle 60 is pivoted by a user/operator from the second position to the first position proximate sliding door 12. To close sliding door 12, a user pivots or applies a force handle 60 in the direction in which first sash 16 slides from open to closed until lead stile 26 of first sash 16 substantially interfaces with door jamb 24. Tongue 56 of anti-slam device 46 is pressed in toward housing 48 of mortise mechanism 42 as lead stile 26 nears jamb 24, disengaging anti-slam device 46. However, handle 60 does not automatically move from the second position to the first position when anti-slam device 46 is disengaged. Further, mortise mechanism 42 is not automatically disengaged when anti-slam device 46 is disengaged or lead stile 26 interfaces with jamb 24. A user must pivot handle 60 from the second position to the first position to counter resistance forces (e.g., friction, as discussed above) maintaining handle 60 in the second position.

Handle 60 is pivoted between the second or unlocked position and the first or locked position by applying a force to handle 60 that includes a vector component in the direction opposite the direction sliding door moves from open to closed and a vector component toward front surface 36 of first sash 16. The direction to move sliding door 12 from the second or open position to the first or closed position may also be described as away from jamb 24. For a right handed user facing front surface 36 of first sash 16, pivoting handle 60 from the second position to the first position typically involves pushing handle to toward the left side of their body and toward front surface 36 of first sash 16. Depending on the user's stance, this motion is substantially across their body. A user typically grips handle 60 at gripping portion 409 to apply such a force.

In this manner, the user may apply a force in the direction of the movement of first sash 16 of sliding door 12 from a second or open position to a first or closed position, i.e. toward jamb 24, in order to close sliding door 12. After closing sliding door 12, there is a transition point or a change in the vector direction of the force applied to handle 60 by the user. A user may then pivot handle 60 between the second or unlocked position and the first or locked position by applying a force to handle 60 having a vector component toward front surface 36 of first sash 16 and a vector component in a direction opposite the direction to move sliding door 12 from a second or open position to a first or closed position, i.e., away from jamb 24. Accordingly, closing sliding door 12 and locking sliding door latch 10 involves applying forces to handle 60 that have substantially opposite force vector components. It follows that a user may pivot/pull and push handle 60 to both unlock sliding door latch 10 and open sliding door 12, and a user may pivot/pull and push handle 60 to close sliding door 12 and lock sliding door latch 10.

There is no need for a user to release any securing or releasing mechanism in addition to pivoting and pushing handle 60, e.g., pushing in a button. A user may touch only second side 401 at gripping portion 409 of handle 60 and be fully capable of operating sliding door latch 10 and sliding door latch 12. Further, a user need not release handle 60 to fully operate both sliding door latch 10 and sliding door 12. Thus, sliding door latch 12 is provides for improved ease of use, even for those persons with limited dexterity.

When a user pivotally moves handle 60 from the unlocked position to the locked position, handle 60 again pivots about handle pivot axis 64. The rotation of handle 60 rotates partial gear portion 508. Partial gear portion 508 rotates about handle pivot axis 64. Partial gear portion 508 operatively rotates pinion 510. As handle and partial gear portion 508 are rotated, gear 556 of pinion 510 rotates. Plurality of teeth 552 of toothed portion 550 of partial gear portion 508 drive teeth 564 such that pinion 510 rotates clockwise. Keyed portion 568 of shaft 558 of pinion 510 is in part received within keyed hole 50 and rotates, disengaging mortise mechanism 42. The biasing device forces hooks 44 out of openings 52 in housing 48. Hooks 44 encounter strike plate 27, securing first sash 16 to jamb 24. Thus, pivoting handle 60 from the second position to the first position when sliding door 12 is closed causes mortise mechanism 42 to be operatively engaged. Sliding door latch 10 is then locked and sliding door 12 is closed.

As discussed above, rotation of handle 60 operatively engages and disengages mortise mechanism 42. In the second embodiment shown in FIGS. 7A-9B, rotational motion of handle 60 about handle pivot axis 64 is translated into rotational motion about a perpendicular axis, pinion axis 236.

Sliding door latch 10 may be further provided according to a number of alternative embodiments that are configured to be operated in the manner discussed above.

For purposes of this disclosure, the term "coupled" means the joining of two components directly or indirectly to one another. Such joining may be stationary in nature or movable in nature. Such joining may be achieved with the two components (electrical or mechanical) and any additional intermediate members being integrally defined as a single unitary body with one another or with the two components or the two components and any additional member being attached to one another. Such joining may be permanent in nature or alternatively may be removable or releasable in nature.

The present disclosure has been described with reference to embodiments, however, workers skilled in the art will recognize that changes may be made in form and detail without departing from the spirit and scope of the disclosure. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example is manifestly intended to be as broad as possible. For example, unless specifically otherwise noted a single particular element may also encompass a plurality of such particular elements.

It is also important to note that the construction and arrangement of the elements of the system as shown in the exemplary embodiments is illustrative only. Although only a certain number of embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Further, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability. Accordingly, all such modifications are intended to be included within the scope of the present disclosure. Other substitutions, modifications, changes and omissions may be made in the design, operating conditions and arrangement of the exemplary embodiments without departing from the spirit of the present subject matter.

What is claimed is:

1. A sliding door latch for use with a sliding door including a first sash having a front surface, the sliding door configured to be opened and closed by opening and closing the first sash relative to a door jamb, the sliding door latch comprising:

a handle having a center gripping portion intermediate a pair of pivotally secured portions defining a handle pivot axis, the handle pivot axis being substantially parallel to and spaced a distance from the front surface of the first sash;

a housing operatively connected to the handle;

a coupling mechanism secured to the handle;

a mortise mechanism operatively coupled to the coupling mechanism, the mortise mechanism including at least one member configured to engage a portion of the door jamb to releasably lock the first sash to the door jamb;

the coupling mechanism operatively coupling the handle to the mortise mechanism, the coupling mechanism including a beveled gear section extending from a portion of the handle intermediate the pair of pivotally secured portions, the beveled gear section connected to a beveled pinion gear; and the handle being pivotable at the pivotally secured portions about the handle pivot axis away from and toward the door jamb, the beveled gear section being rotated with the pivoting of the handle and directly moving the beveled pinion gear, the movement of the beveled pinion gear operatively disengaging the mortise mechanism from the door jamb thereby unlocking the sliding door.

2. The sliding door latch of claim 1, wherein the mortise mechanism prevents the handle from pivoting when the sliding door is open.

3. The sliding door latch of claim 1, wherein the handle is a U-shaped handle, the pivotally secured portion including a first pivotally secured end and a second pivotally secured end.

4. The sliding door latch of claim 1, wherein the handle is a substantially rectangular handle having a first side substantially opposite and parallel to a second side, the handle being pivotally secured to the housing at the first side and the second side including the gripping portion.

5. The sliding door latch of claim 1, wherein unlocking the door by pivoting the handle is substantially accomplished by rotating the handle about the handle pivot axis and opening the sliding door is substantially accomplished by pushing the handle in the direction to move the first sash from closed to open.

6. The sliding door latch of claim 1, wherein the handle is further configured to receive a force in the direction to move the first sash from open to closed in order to close the sliding door and then to be pivoted by applying a force to the handle that includes a vector component toward the front surface of the first sash and a vector component in the direction opposite the direction to move the first sash from open to closed in order to lock the sliding door latch.

7. The sliding door latch of claim 1, wherein the handle is pivotable only when the sliding door is closed.

8. The sliding door latch of claim 1, wherein the handle is maintained in a given position when the sliding door is closed until force is applied to the handle to pivot it about the handle pivot axis.

9. The sliding door latch of claim 1, wherein the sliding door latch provides sufficient frictional forces to prevent the handle from pivoting about the handle pivot axis without a force applied by a user when the sliding door is closed.

10. The sliding door latch of claim 1, wherein the handle is configured to be pivoted from by applying a force to handle that includes a vector component away from the front surface of the first sash and a vector component in the direction opposite the direction to move the sliding door from closed to open in order to unlock the sliding door latch, and then receive a force in the direction to move the sliding door from closed to open in order to open the sliding door.

11. A sliding door latch for use with a sliding door including a first sash having a front surface, the sliding door configured to be opened and closed by opening and closing the first sash relative to a door jamb, the sliding door latch comprising:

a handle having a gripping portion and a pivotally secured portion defining a handle pivot axis, the handle including a first side facing away from the first sash and a second side facing toward the first sash;

a housing operatively connected to the handle;

a mortise mechanism;

a coupling mechanism operatively coupling the handle to the mortise mechanism, the coupling mechanism including a first partial gear portion fixed to the second side of the handle, the partial gear portion including a toothed portion having a plurality of bevel-cut teeth, the part, the partial gear portion being directly connected to a beveled gear pinion, and the handle being pivotable at the pivotally secured portion about the handle pivot axis away from and toward the door jamb, the first partial gear portion being rotated with the pivoting of the handle and operatively moving the pinion gear, the movement of the pinion gear operatively disengaging the mortise mechanism from the door jamb thereby unlocking the sliding door.

12. The sliding door latch of claim 11, wherein the first partial gear portion is substantially centered and pivotable about the handle pivot axis and the pinion gear rotates about a pinion axis perpendicular to the handle pivot axis.

13. The sliding door latch of claim 12, wherein the at least first partial gear portion is pivotable about the handle pivot axis.

14. A method for operating a sliding door including a sliding sash having a front surface, comprising:

providing a handle pivotally secured to the sliding sash along a pivot axis that is perpendicular to the vector direction that the sliding sash moves between an open and closed position, providing a partial bevel gear section on a portion of the handle intermediate a first pivot point and a and second pivot point defining a handle pivot axis about which the handle pivots;

providing a beveled pinion gear that operatively engages the partial bevel gear section, where the beveled pinion gear is operatively connected to a mortise lock;

unlocking a sliding door latch by rotating a handle about the handle pivot axis from a first position wherein the sliding door latch is locked and a top side of the handle is at a first angle relative to a front surface of the first sash to a second position wherein the sliding door latch is unlocked and the top side of the handle is at a second angle relative to the front surface of the first sash that is different than the first angle;

opening the sliding door by applying a force to the handle in the direction to move the sliding door from closed to open, separating the first sash from a door jamb;

closing the sliding door by applying a force to the handle in the direction to move the sliding door from open to closed; and locking the sliding door latch by pivoting the handle.

15. The method for operating a sliding door of claim 14, wherein pivoting the handle about the handle pivot axis to lock the sliding door from the second position to the first position includes applying a force to the handle that includes a vector component toward the front surface of the first sash and a vector component in the direction opposite the direction to move the sliding door from closed to open.

16. The method for operating a sliding door or claim 14, further comprising maintaining the handle in the second position unless the sliding door is closed.

17. The method for operating a sliding door of claim 14, further comprising providing sufficient frictional forces to prevent the handle from pivoting from the second position to the first position without a force applied by a user when the sliding door is closed.

18. The method for operating a sliding door of claim 14, further comprising providing a locking mechanism having an anti-slam device, the anti-slam device prevents the handle from pivoting from the second position.

* * * * *